US005772385A

United States Patent [19]

Huntoon et al.

[11] Patent Number: 5,772,385

[45] Date of Patent: Jun. 30, 1998

[54] LIFT MECHANISM FOR LIFTING REFUSE CONTAINERS

[75] Inventors: Russell Curtis Huntoon; Thomas Frederick Dickman, both of Sparks, Nev.

[73] Assignee: Automated Refuse Equipment, Inc., Reno, Nev.

[21] Appl. No.: 646,750

[22] Filed: May 6, 1996

Related U.S. Application Data

[63] Continuation-in-part of Ser. No. 349,625, Dec. 5, 1994, Pat. No. 5,513,937.

[51] Int. Cl.[6] ..... B65F 3/02

[52] U.S. Cl. ..... 414/408; 414/420; 414/421

[58] Field of Search ..... 414/406–409, 414/419–421, 303

[56] References Cited

U.S. PATENT DOCUMENTS

| | | | |
|---|---|---|---|
| 2,592,085 | 4/1952 | Van Doorne | 414/421 X |
| 3,327,876 | 6/1967 | Kolling | 414/406 |
| 3,738,516 | 6/1973 | Wells | 144/421 X |
| 3,747,785 | 7/1973 | Dahlin | 414/421 X |
| 3,804,277 | 4/1974 | Brown et al. | 414/421 X |
| 3,894,642 | 7/1975 | Shive | 414/421 X |
| 3,931,901 | 1/1976 | Jones | 414/421 X |
| 4,057,156 | 11/1977 | Thompson et al. | 414/420 X |
| 4,365,922 | 12/1982 | Borders | 414/406 |
| 4,422,814 | 12/1983 | Borders | 414/420 X |
| 4,479,751 | 10/1984 | Wyman et al. | 414/406 |
| 4,566,840 | 1/1986 | Smith | 414/420 X |
| 4,597,710 | 7/1986 | Kovats | 414/409 |
| 4,613,271 | 9/1986 | Naab | 414/303 |
| 4,687,405 | 8/1987 | Olney | 414/408 |
| 4,773,812 | 9/1988 | Bayne et al. | 414/408 |
| 4,989,917 | 2/1991 | Schmidt, Jr. | 414/421 X |
| 5,002,450 | 3/1991 | Naab | 414/303 |
| 5,026,241 | 6/1991 | Wyman | 414/303 |
| 5,028,196 | 7/1991 | Richards | 414/406 |
| 5,256,027 | 10/1993 | Guest | 414/421 X |
| 5,308,211 | 5/1994 | Bayne | 414/408 |
| 5,333,984 | 8/1994 | Bayne et al. | 414/408 |
| 5,344,272 | 9/1994 | Nuyts | 414/421 X |
| 5,466,110 | 11/1995 | Redding | 414/408 X |
| 5,513,937 | 5/1996 | Huntoon et al. | 414/408 |
| B1 4,773,812 | 4/1991 | Bayne et al. | 414/408 |

FOREIGN PATENT DOCUMENTS

| | | |
|---|---|---|
| 2459779 | 1/1981 | France . |
| 1248541 | 2/1964 | Germany . |
| 1240776 | 8/1965 | Germany . |

*Primary Examiner*—David A. Bucci
*Attorney, Agent, or Firm*—Bell Seltzer Intellectual Property Law Group Alston & Bird, LLP

[57] ABSTRACT

A lift mechanism for use with a refuse collection vehicle for lifting and dumping refuse carts. The device includes a frame which is adapted for mounting on a refuse collection vehicle and a pan assembly which is adapted to engage refuse carts. A pair of guide arms provided which have a first end pivotally connected to a frame and a second end which is pivotally connected to the pan assembly. A first actuator arm is provided having a first end connected to the frame and a second end connected to a reciprocating actuator. A pair of second actuator arms is provided having a first end connected to a frame and having a second end connected to the pan assembly. A connecting arm is pivotally connected at a first end to a second end of the first actuator arms and at a second end to the second actuator arms at a location between the first end and second end of the second actuator arms. The connecting arm provides corresponding movement of the second actuator arm in response to movement of first actuator arm. The reciprocating actuator moves the pan assembly through the first actuator arms, the connecting arm, and the second actuator arms between a receiving position for engaging the refuse cart and a dumping position for emptying the refuse cart.

10 Claims, 17 Drawing Sheets

LIFT MECHANISM FOR LIFTING REFUSE CONTAINERS

RELATED APPLICATION

The present application is a continuation-in-part of co-pending application Ser. No. 08/349,625, filed on Dec. 5, 1994, now issued as U.S. Pat. No. 5,513,937, and is hereby incorporated herein in its entirety by reference.

FIELD OF THE INVENTION

The present invention relates to the field of refuse collection systems, and, more particularly, to a lift mechanism adapted for use with a refuse collection vehicle for lifting and dumping refuse containers.

BACKGROUND OF THE INVENTION

The desire to reduce the cost and increase the ease and speed of refuse collection, in conjunction with improvements in automation techniques, has resulted in substantial changes in the collection of residential and commercial refuse. As the technology of carts and lift mechanisms developed, several different styles of carts and lift mechanisms have emerged. However, despite these differences, most modern refuse collection systems include carts having wheels, which allow them to be rolled to the street curb, where they are lifted and dumped by a semi or fully automated lift mechanism.

Regardless of the type of lift mechanism being used, there are common problems which each has attempted to solve. For instance, the overall size of the lift mechanism is an important factor. The width or profile of the lift mechanism has a dramatic effect on both the desirability of the device to potential purchasers and on the ease of use. Specifically, the width or profile of the lift mechanism may limit its use in cities which have narrow residential streets. In Europe for example, it is important to minimize the profile of the lift mechanism be as slender as possible so that the refuse collection vehicle can operate on narrow streets and in confined spaces.

The profile of the lift mechanism is also important for rear load refuse collection vehicles. If the lift mechanism projects too far out from the rear of the refuse collection vehicle, it will effect the ability of the vehicle to operate in tight areas and/or limit access to the refuse collection hopper, i.e., make it more difficult to empty loose refuse, by hand, into the collection hopper. Examples of rear load lift mechanism which have a wide profile are disclosed in U.S. Pat. Nos. 3,738,516 to Wells and 4,479,751 to Wyman et al.

Similarly, if the vehicle is to be used for a mixed route, i.e., commercial and residential refuse collection, as disclosed in U.S. Pat. Nos. 4,741,658, 4,911,600, 5,069,593, and 5,257,877 to Zelinka et al. and 4,687,405 to Wyman et al., then the width or profile of the lift mechanism cannot be such that it prevents or hinders the commercial container lift mechanism from being used.

This desire to obtain a lift mechanism with a slender width or profile has resulted in several different approaches to the problem. For example, U.S. Pat. No. 4,057,156 to Thompson et al. discloses the use of track system which is attached to the side of the refuse collection vehicle for lifting and dumping the cart. A track mounted to the refuse collection vehicle has also been used by Applicant in its Foothill device. Similarly, U.S. Pat. No. 4,597,710 to Kovats uses a pair of vertical guide rails secured to a refuse collection vehicle for lifting and dumping a refuse cart.

An alternative approach is disclosed by Bayne et al. in U.S. Pat. Nos. 5,333,984, 5,308,211, and 4,773,812. Each of the Bayne et al. patents, utilize a reciprocating cylinder to activate a rack and pinion arrangement for rotating an output shaft attached thereto. The output shaft has a pair of arms attached at opposed ends thereof for rotation therewith. Bayne et al. state that the use of a rack and pinion arrangement to drive the output shaft solves the problem of a continuously smooth rotation of the lift mechanism throughout the operating cycle. In addition, Bayne et al. position two cylinders on the same side of the housing relative to the output shaft so as to narrow the profile of the lift mechanism and thereby attempt to solve the width problem. Others have also attempted to address the width and smoothness problems by utilizing similar arrangements; see for instance, U.S. Pat. Nos. 3,804,277 to Brown et al., 3,894,642 to Shive, 4,365,922 to Borders, and 4,687,405 to Olney.

However, by attempting to address the problems of a slender profile and a smooth operation of the lift mechanism, the above-referenced approaches have created an additional problem. Specifically, the ability of the lift mechanism to smoothly handle a weight, often in excess of two (200) hundred pounds, without jerking is important from both a speed of collection and a maintenance cost perspective. In addition, the ability to effectively handle the weight of a cart which is slightly off center on the lift mechanism without causing damage to the lift mechanism due to the additional torsional stress is important to the mechanical longevity of the device. Although various prior art patents, such as the Bayne et al. patents, use a rack and pinion arrangement to drive the output shaft and thereby obtain a slender profile, such an arrangement has a negative effect on the overall lifting strength of the lift mechanism.

Furthermore, the use of the above-referenced approaches have a secondary problem in that they are often not well suited for dual use with both residential and commercial carts because of the additional size and weight normally associated with the commercial carts. Accordingly, a choice must be made to either limit the lift mechanism to residential carts or sacrifice the slender profile of their lift mechanism to accommodate larger components necessary to support the extra weight of commercial carts.

It is also desirable for side load lift mechanisms to be able to carry the refuse cart as far back into the hopper of the refuse collection vehicle as possible so that the operator of the refuse collection vehicle does not have to activate the compactor as often to move the refuse toward the end of the hopper opposite the location of the lift mechanism. Limiting the frequency of activation of the compactor greatly extends its useful life, thereby reducing the associated mechanical costs. Various attempts have been made to improve the ability of the lift mechanism to position the refuse cart as far back into the hopper as possible when inverted in the dump position. Examples of such attempts are disclosed in U.S. Pat. Nos. 4,365,922 and 4,422,814 to Borders, and 5,002,450 to Naab.

The problem with several of these approaches is that the lift mechanism sacrifices stability by overextending the lever arms past the longitudinal axis of the lift mechanism. As a result, the entire weight of the extended lever arm and the refuse cart is carried by one pivot point which greatly increases the wear associated with the lift mechanism.

Current technology is such that a slender profile lift mechanism sacrifices the ability to lift both residential and commercial refuse containers. Conversely, while wide profile lift mechanisms can handle both residential and commercial refuse containers, they sacrifice the ability to operate in confined areas. In addition, several of the existing lift mechanisms have a slender profile use a rotary actuator or similar mechanism to lift the refuse cart between the receiving and the dumping positions. The complexity of rotary actuators, the need to rotate the lift arms at least 180° between the receiving and dumping position and the associated high costs of operation and maintenance makes such lift mechanisms less than ideal. Consequently, existing lift mechanisms are forced to choose between a slender profile which provides some of the desired characteristics of the lift mechanism or the ability to smoothly handle residential refuse containers throughout the lifting and dumping cycle.

Moreover, various existing lift mechanism are either incapable of lifting the refuse cart a sufficient distance into the hopper of the refuse collection vehicle to minimize use of the compactor or they are forced to extend the lifting arms well beyond the midline of the lift mechanism. This in turn results in additional strain and wear on the device while making it unstable under load.

SUMMARY OF THE INVENTION

In view of the foregoing background, it is therefore an object of the present invention to provide a lift mechanism for use with a refuse collection vehicle for lifting and dumping refuse containers which is capable of smoothly lifting substantial weight and which has a slender profile, while being cost effective to operate because of reduced maintenance requirements.

These and other objects, features, and advantages of the present invention are obtained by providing a frame which can be adapted for mounting on a refuse collection vehicle. Alternatively, the frame may form a portion of the refuse collection vehicle. When this is the case, a series of supports are preferably used to support those elements which need to be connected to the vehicle to provide stability to the device. Advantageously, a pan assembly is adapted to engage the refuse carts. The pan assembly has a face plate which may easily be modified to engage either domestic or European carts. A guide arm is provided which has a first end pivotally connected to the frame and has a second end which is pivotally connected to the pan assembly. A first actuator arm is also provided which preferably has a first end and a second end, wherein the first end is connected to the frame. A second actuator arm is provided having a first end which is preferably connected to the frame and having a second end preferably connected to the pan assembly.

A connecting arm is pivotally connected at a first end to a second end of the first actuator arm and at a second end pivotally connected to the second actuator arm at a location between the first end and the second end of the second actuator arm to provide a corresponding movement of a second actuator arm in response to movement of the first actuator arm. A reciprocating actuator is provided having a first end pivotally connected to the frame and a second end pivotally connected to the first actuator arm at a location spaced from the first end of the actuator whereby the pan assembly is selectively movable between a receiving position for engaging the refuse cart and a dumping position for emptying the refuse cart in response to linear reciprocating movement of the actuator.

Advantageously, a shock absorber is provided to cooperate with a cross bar fastened to the frame to limit and smoothly slow rotation of the first actuator arm as it approaches the dumping position. The shock absorber and the cross bar thereby prevent over extension of the first actuator arms so that the weight of the pan assembly and the refuse cart remains substantially over the frame. In addition, it is advantageous to provide adjustable ends for the connecting arm to enable the operator to make minor adjustments to the pan assembly, in the field, to ensure the desired orientation of the pan assembly relative to the frame in both the dumping and the receiving position. To assist in obtaining the desired orientation of the pan assembly in the dumping position, it is helpful for the second actuator arms include a 45° angle bend therein.

Preferably, the device includes a first pivot shaft and a second pivot shaft such that each pivot shaft extends the width of the frame. It is advantageous for the first and second pivot shafts to be in generally parallel alignment and be longitudinally spaced on a frame from each other. Such an arrangement of the pivot shafts provides the lift mechanism with additional torsional rigidity, thereby increasing the stability and smoothness of operation of the lift mechanism.

A retaining means, preferably in the form of a bearing assembly, is located between the frame and the first end of the guide arm and between the pan assembly of the second end of the guide arm. The bearing assembly thereby enables pivotal movement therebetween while retaining the desired alignment of the pan assembly relative to the frame during movement thereof. It is beneficial for the bearing assembly to include a generally cylindrical body portion having a shoulder adjacent a first end thereof and have a cylindrical rib spaced from the shoulder. The body portion should include a threaded turning end for receiving or cooperating with a driver to threadedly mount the body portion to the pan assembly and the frame.

Preferably, a bearing such as a needle bearing is circumferentially positioned on the body portion between a rib and the shoulder to accommodate for any torsional forces or minor misalignment which may occur. It is advantageous for a threaded shaft to extend outward from the body portion adjacent the shoulder for threadedly receiving a fastener to secure one end of the guide arm to the frame, thereby ensuring that the guide arm remains positioned over the bearing. If a non-sealed bearing is used, it is helpful to provide a grease valve which is press fitted into a bore in the threaded shaft and is in fluid communication with a plurality of grease apertures located on the body portion between the shoulder and the rib. Such an arrangement ensures that both the body portion and the bearing remains lubricated.

Ideally, the guide arm, the first actuator arm, and the second actuator arm have corresponding second arms which are cooperatively connected thereto to ensure corresponding movement therewith. The advantage of having the guide arm, the first actuator arm, and the second actuator arm, in corresponding pairs is that such a configuration, in cooperation with the first and second pivot shafts and the frame, improves both rigidity and torsionally stability of the lift mechanism.

The reciprocating actuator is preferably connected to the first actuator arm at a location approximately one third of the distance from the first end of the actuator arm. This positioning allows the actuator to move the first actuator arms through a small or limited arcuate path while, because of the connecting arm and the second actuator arm, the pan assembly raises to the desired dumping position well into the hopper. This benefits the longevity of the refuse collection vehicle because compactor does not have to be operated as frequently as in prior art devices. In addition because of the location of the pan assembly in the dumping position, there is ample clearance to run the compactor simultaneously with the dumping operation which helps to speed up refuse collection. The relationship of the actuator and the first actuator arms also has the benefit of transferring the force from the actuator to the first actuator arms in an efficient manner resulting in both an improved lifting capacity over various prior art devices and smoother operation while maintaining the speed of the operating cycle. An additional actuator is also preferably provided to controllably slow the pan assembly at predetermined points along its arcuate path to ensure a smooth operating cycle without sacrificing operating speed.

The lift mechanism of the present invention can have a slender profile when in the receiving and stowing position because the pair of first actuator arms and the pair of second actuator arms can be constructed so as to nest within the pair of guide arms and within the frame. The relationship of the pan assembly to the cart in conjunction with the actuator and the lever arms allows the cart to be lifted straight up even though the pan assembly has an arcuate path. To assist the device in obtaining higher vertical lift and dumping location, to operate on refuse collection vehicles having a collection hopper opening located higher on the truck body the device may also be provided with a pair of laterally spaced slide bars which are slidably attached to the frame for vertically raising the frame before the pan assembly begins rotational movement from its receiving position.

Furthermore, in various embodiments of the invention, a second lift mechanism is adapted to be attached to the refuse collection vehicle adjacent the first lift mechanism. Ideally, a connecting bar is provided for connecting the first and second lift mechanisms to enable them to work in unison for receiving and dumping commercial refuse carts. The first and second lift mechanisms may also operate independently from one another. Alternatively, it is possible to position the second lift mechanism on the opposed side of a side loading refuse collection vehicle to thereby enable refuse carts to be simultaneously collected on both sides of the refuse collection vehicle.

The foregoing objectives, features, and advantages may also be achieved by providing a lifting apparatus for use with a refuse collection vehicle for lifting and dumping a refuse carts comprising a frame adapted for mounting to the refuse collection. The lift mechanism includes a pan assembly adapted to engage the refuse cart. A reciprocating actuator is provided having a first end and a second end movable relative to said first end. At least two four bar linkages, which are pivotally connected between the pan assembly and the reciprocating actuator, are provided for moving the pan assembly along a predetermined path between a receiving position for engaging the refuse cart and a dumping position for emptying the refuse cart. The at least two four bar linkages are used to move the pan assembly from the receiving position to the dumping position in response to a predetermined constant movement of the second end of the reciprocating actuator.

Preferably this predetermined constant movement of the second end of the reciprocating actuator results in acceleration of the pan assembly along an initial portion of the predetermined path of the pan assembly and subsequent decelerate the pan assembly along a terminal portion of the predetermined path.

Advantageously, the four bar linkages are connected in series. In addition it is preferable for the two four bar linkages to be formed from a first actuator arm connected at a first end to the frame and having a second end, a second actuator arm having a first end connected to the frame and having a second end connected to the pan assembly, a connecting arm having a first end pivotally connected to the second end of the first actuator arm and having a second end pivotally connected to second actuator arm for providing corresponding movement of the second actuator arm in response to movement of the first actuator arm, and a guide arm having a first end pivotally connected to the frame and having a second end pivotally connected to the pan assembly for guiding said pan assembly along the predetermined path of travel.

It is beneficial for the connecting arm to include one and preferably two adjustable ends to allow for adjustment of the pan assembly to obtain the desired orientation thereof in both the receiving position and the dumping position. This ability to adjust the position of the pan assembly in conjunction with the ability of at least a plurality of the arms to nest within the pan assembly provides the lift mechanism with a slender profile in the receiving position.

BRIEF DESCRIPTION OF THE DRAWINGS

Some of the objects and advantages of the present invention having been stated, others will become apparent as the description proceeds when taken in conjunction with the accompanying drawings, in which.

DETAILED DESCRIPTION OF THE INVENTION

Figure 1:
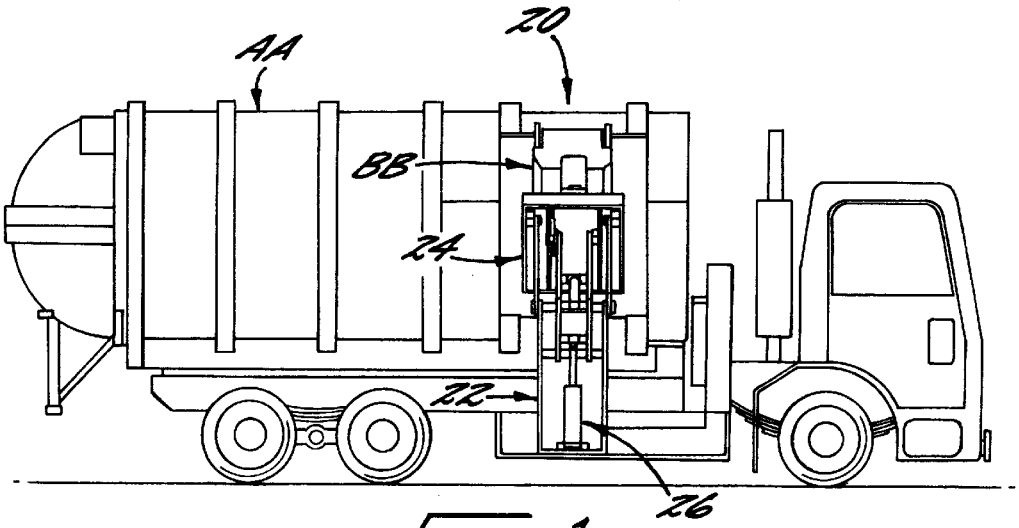
FIG. 1 is a side view of a refuse collection vehicle utilizing the lift mechanism in accordance with the present invention.

The present invention now will be described more fully hereinafter with reference to the accompanying drawings in which a preferred embodiment of the invention is shown. This invention may, however, be embodied in different forms and should not be construed as limited to the embodiments set forth herein. Rather, the illustrative embodiments are provided so that this disclosure will be thorough and complete, and will fully convey the scope of the invention to those skilled in the art to which it pertains. Like numbers refer to like elements throughout.

Referring to the drawings, a first embodiment of the invention is shown in FIGS. 1–9. In this embodiment, a lift mechanism generally designated as 20 is intended to be mounted to a refuse collection vehicle AA. In this instance, the lift mechanism 20 is mounted on the refuse collection vehicle AA as a side loader. It is to be understood however, that the lift mechanism 20 may also be used as a front loading device, a rear loading device or a free standing device.

As shown, the lift mechanism 20 includes a frame, generally designated as 22, which attaches to the refuse collection vehicle AA by conventional means such as by bolting or welding. The lift mechanism 20 also includes a movable pan assembly, generally designated as 24 and a linearly reciprocating actuator, generally designated as 26.

Figure 3:
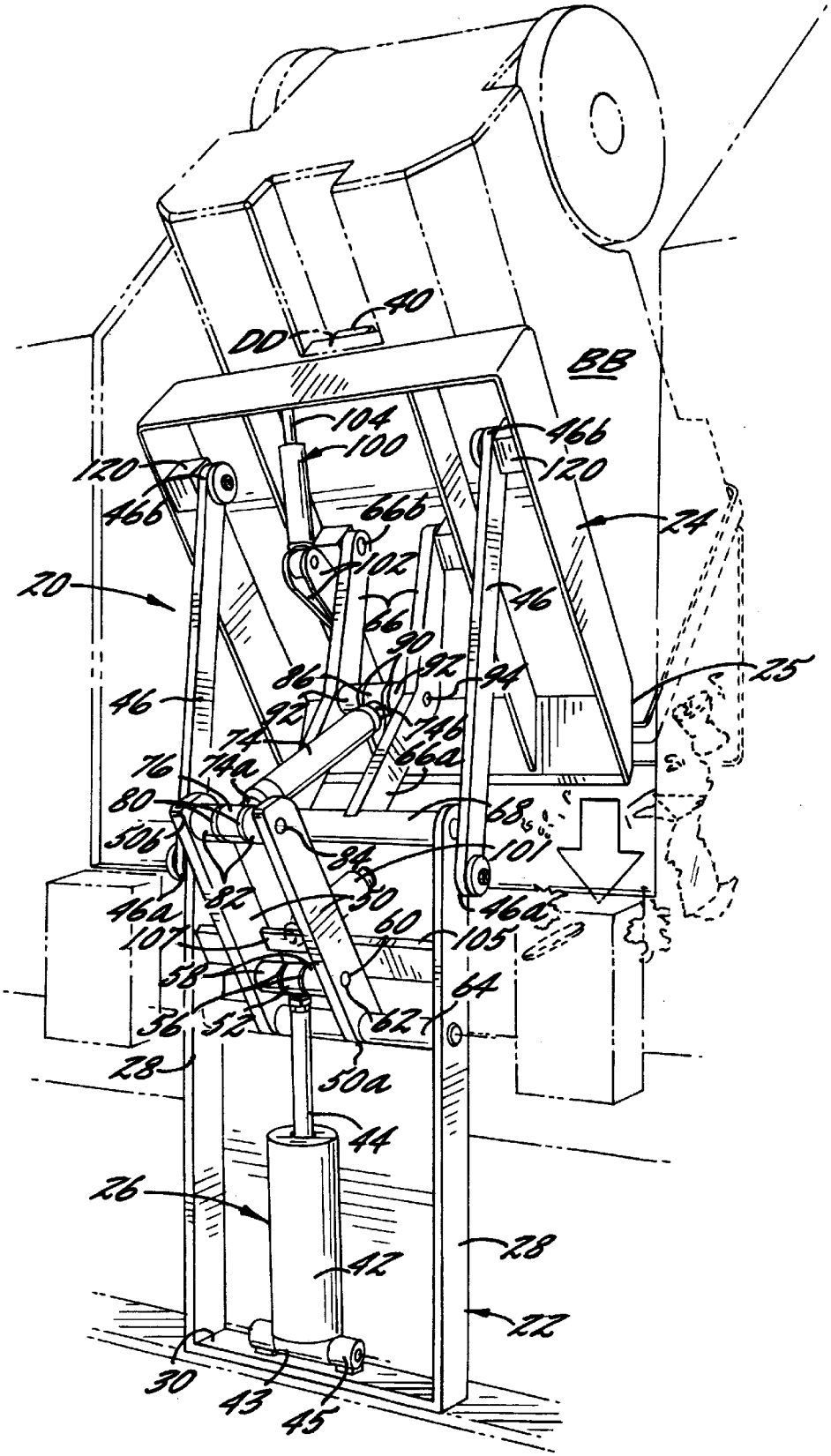
FIG. 3 is a side view in perspective of the lift mechanism in the dumping position.
Figure 6:
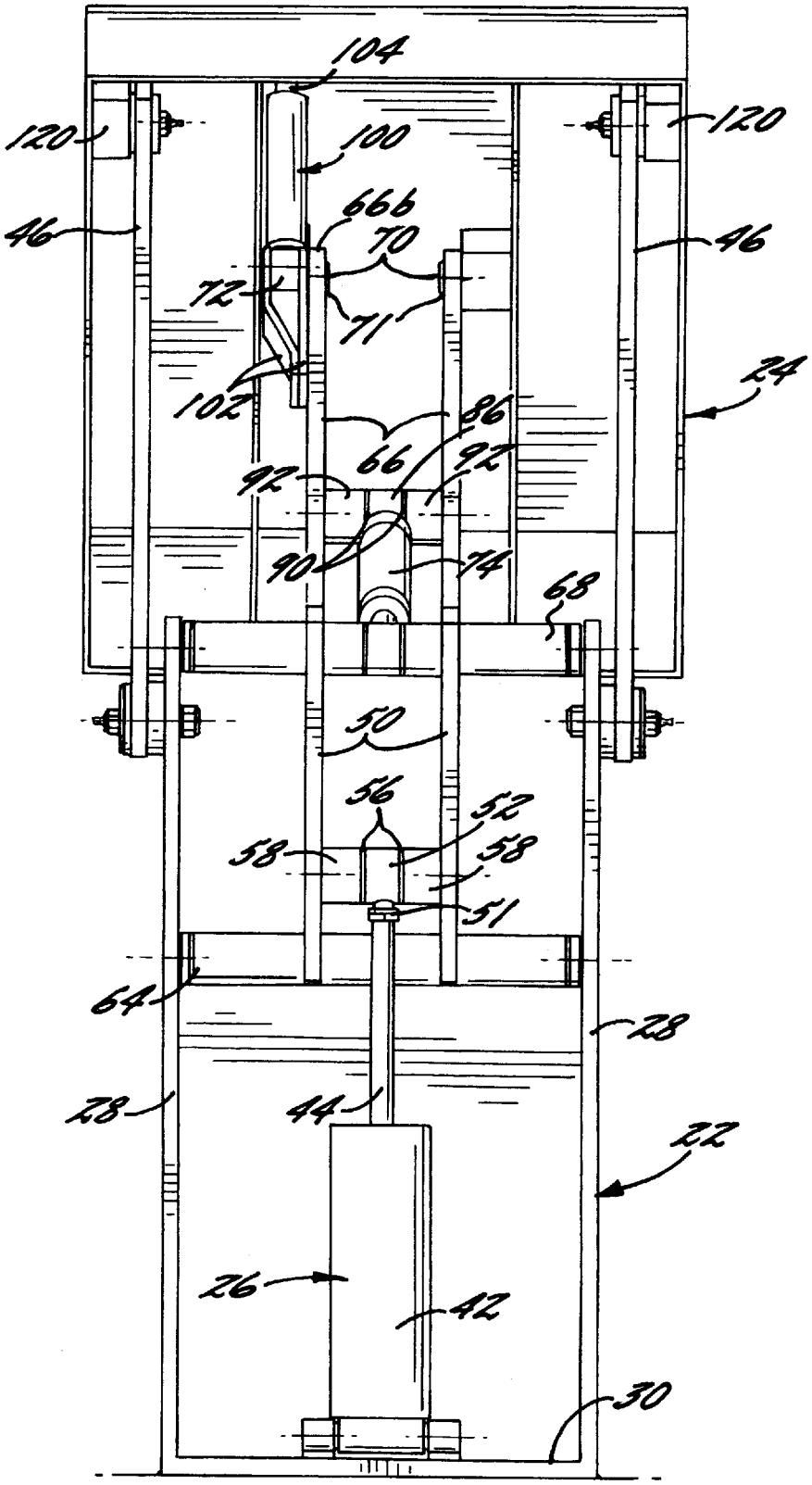
FIG. 6 is a front view of the lift mechanism when in the dumping position.
Figure 7:
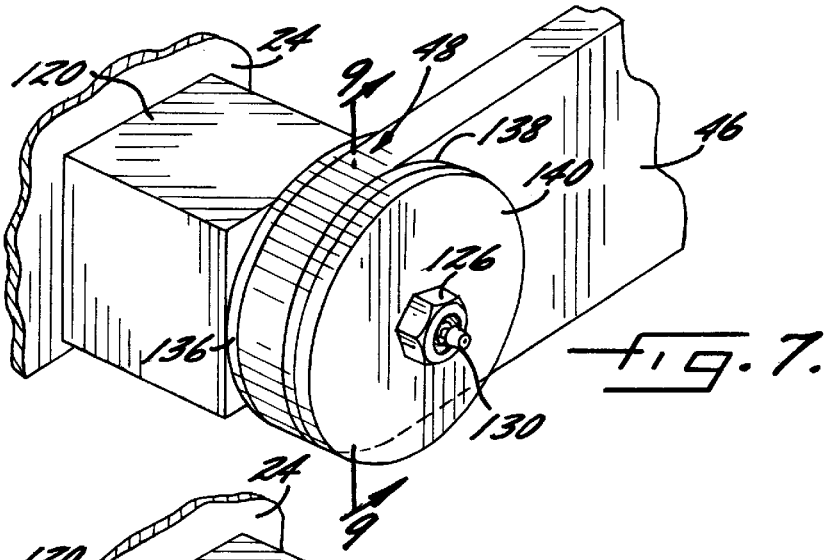
FIG. 7 is a partial view of the guide arm showing the guide arm attached to the pan assembly.
Figure 8:
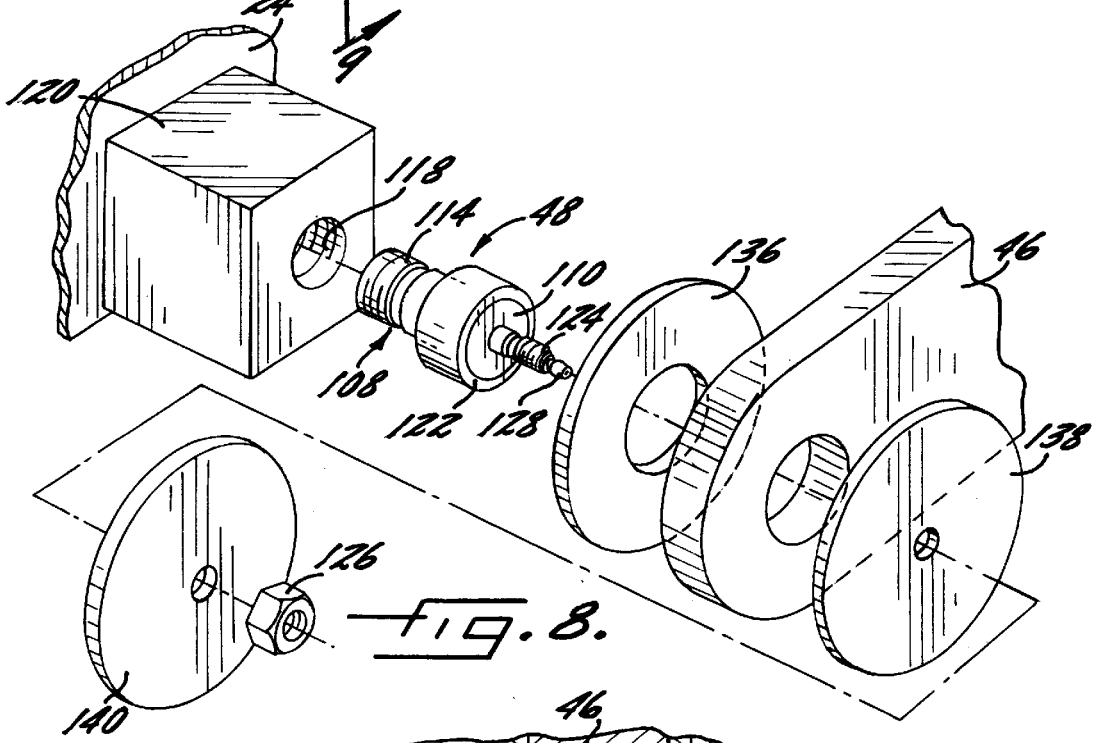
FIG. 8 is an exploded view of the retaining means shown in FIG. 7.
Figure 9:
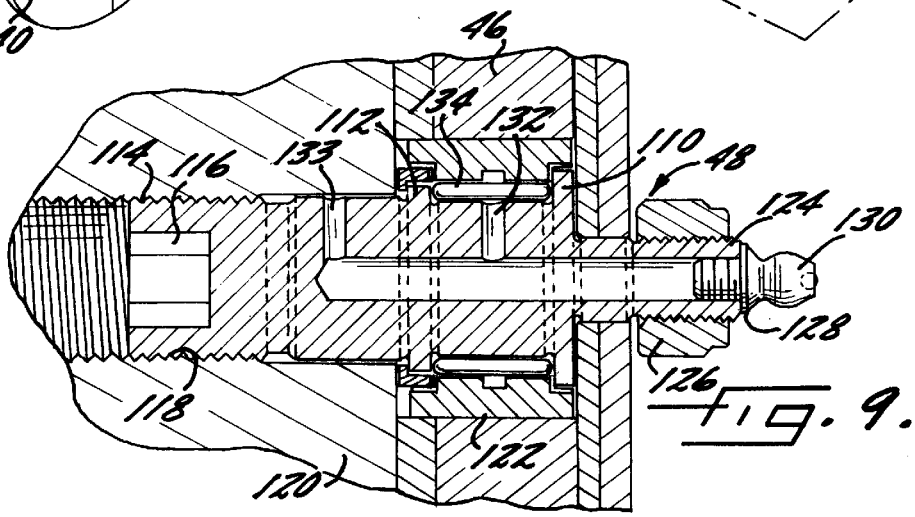
FIG. 9 is a cross-sectional view taken along line 9—9 of FIG. 7.

The frame 22, as best shown in FIGS. 3 and 6, is formed from a pair of side members 28 which are joined by a bottom member 30. Each of the frame members 28 and 30 have a generally rectangular cross-section. It is to be understood however, that the cross-sectional shape of the frame members may vary significantly and remain within the spirit of the inventions so long as the frame members are constructed from a gauge of steel which ensures that the lift mechanism 20 is torsionally stable and capable of supporting substantial weight. The frame 22 forms a generally U-shaped configuration and, in this configuration, is attached to the refuse collection vehicle AA along back edges of the side members 28 along the bottom of the bottom member 30. Alternatively, the frame 22 may form a portion of the refuse collection vehicle AA and a series of supports (not shown) will be used to retain and support elements of the lift mechanism 20.

Figure 2:
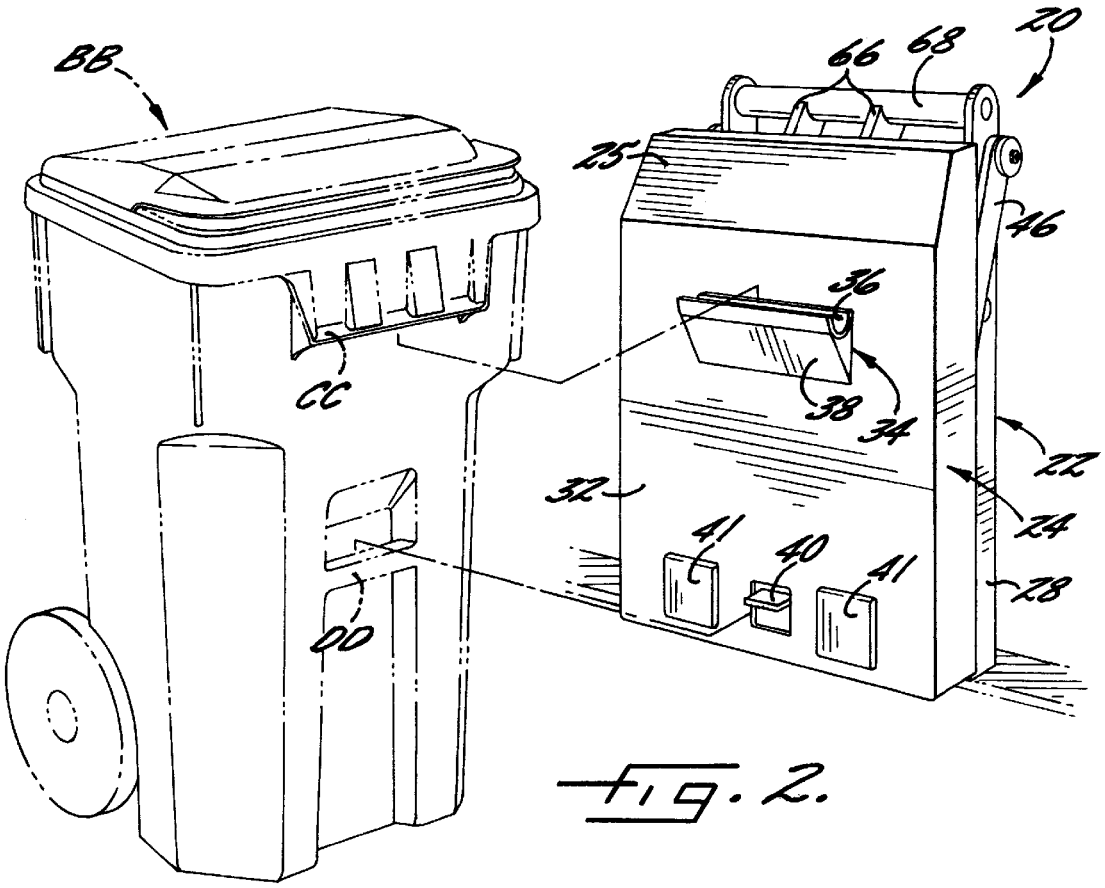
FIG. 2 is a perspective view of a refuse container in the lift mechanism in the receiving position.

The pan assembly 24 is best shown in FIGS. 2 through 6. As shown in FIG. 2, the pan assembly 24 has a generally rectangular configuration having a substantially flat bottom and sides, and an angled portion 25 adjacent the top of the pan assembly. The angled portion 25 allows the pan assembly 24 to be positioned deeper into the interior of the truck hopper when in a dumping position. The pan assembly 24 also includes a face plate 32 which has an variety of possible engagement means to engage and releasably retain one of a plurality of different refuse carts, generally designated as BB. In this particular embodiment, the refuse cart BB shown, is a domestic or U.S. residential cart. Accordingly, the configuration of the face plate 32 must be such that the cart BB can be easily engaged and retained by the pan assembly 24. In this instance, the face plate 32 has an upper hanger 34 which, as shown in FIG. 2, engages a lip CC to ensure that the cart BB is securely seated on the hanger 34 prior to movement of the pan assembly 24 from a receiving position as shown. In this embodiment of the invention, the receiving position and the stowed position—the position of the lift mechanism when not in use, i.e., in between lifting cycles and prior to movement away from the refuse collection vehicle, are the same.

The upper hanger 34 of this embodiment is formed from a generally U-shaped seat 36 and a support member 38. The seat 36 and the support member 38 may be releasably secured to each other and the face plate 32 by conventional means such as welding or by means of a fastener, such as a bolt 39. The use of bolts 39 to secure the upper hanger 34 provides the lift mechanism with the ability to be easily adapted to accept alternate engagement means, such as a European DIN standard hanger (discussed below). As is readily understood by those skilled in the art to which the invention relates, that the shape of the seat 36 and the support member 38 may vary significantly while still performing the function of retaining the lip CC of the cart BB. A lower latch 40 is used to engage a catch bar DD formed in the cart BB to ensure that the cart, when in the dumping position, shown in FIG. 3, remains on the face plate 32. In this embodiment, because the catch bar DD has a generally rectangular cross-sectional configuration, the lower latch 40 has a corresponding shape, in this case, a generally L-shaped configuration to make sure that the cart BB remains on the pan assembly 24 when inverted. It is to be understood that the shape of the lower latch 40 may vary significantly and still remain within the spirit of the invention. This is especially true since many of the catch bars used on other refuse carts BB are round. A pair of pads 41 are attached to the face plate 32 on either side of the lower latch 40. The pads 41 are made of UHMW plastic or a similar material which is both durable when exposed to repeated use and weather and which has cushioning characteristics so as to protect the cart BB from damage as it is brought into contact with the face plate 32.

To move the pan assembly 26 from a receiving position to a dumping position, as shown in FIGS. 4A through 4D, requires the use of the reciprocating actuator 26 and a series of cooperating levers which, in conjunction with the frame 22 and the pan assembly 24, form a series of four-bar linkages.

As used herein, the term "four-bar linkage" refers to a series of four structures, or links, each of which is pivotally interconnected to two other links, so that the entire linkage has one degree of freedom of movement. This term is intended to encompass both conventional four-bar linkages, such as that illustrated herein, and their equivalents, such as slider-crank mechanisms. See, e.g., Paul, *Kinematics and Dynamics of Planar Machinery* (Prentice-Hall, Inc., Englewood Cliffs, N.J. 1979) for a general discussion of four-bar linkages and their equivalents. This term is also intended to encompass multiple four-bar linkages interconnected in series.

Figure 4A:
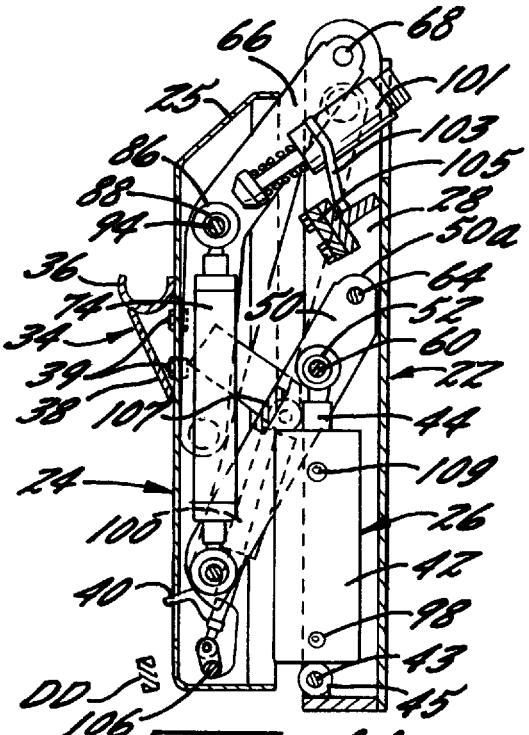
FIGS. 4A–4D is a side view of the lift mechanism as it moves from the receiving position to the dumping position.
Figure 4B:
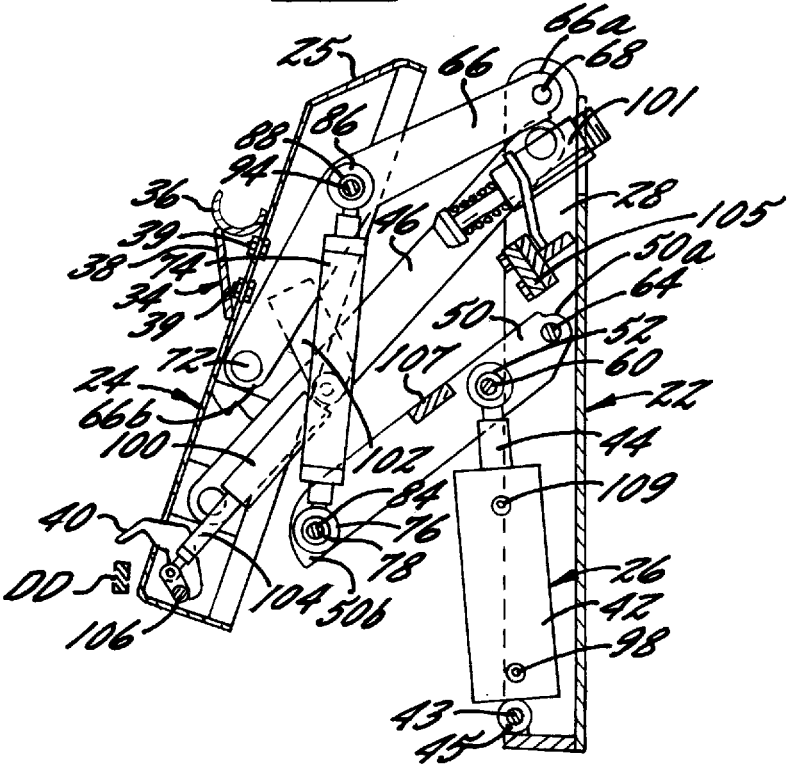
Figures 4C, 4D:
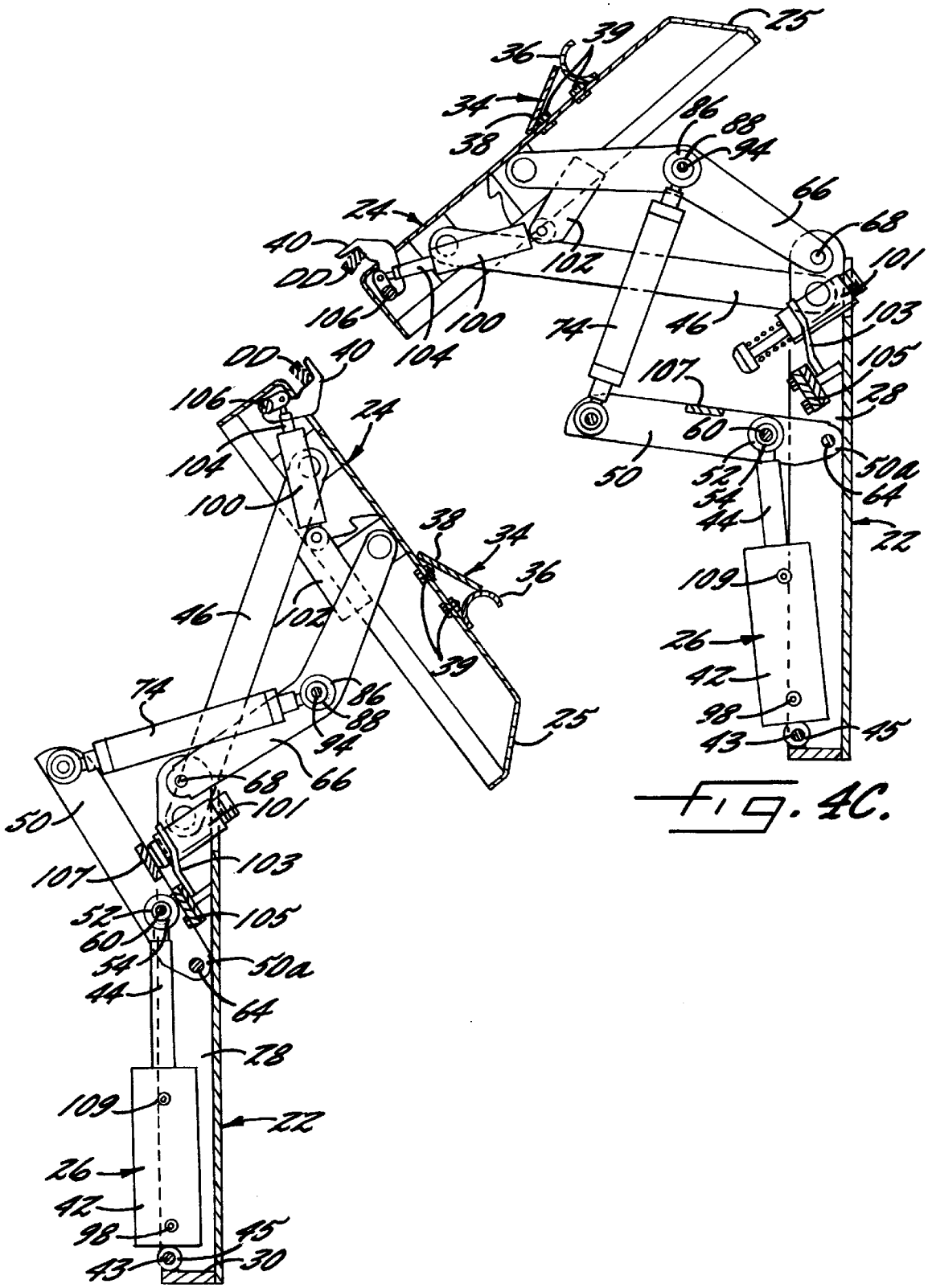

In this embodiment, the reciprocating actuator 26 is a hydraulic cylinder which has a cylinder 42, into which a cylinder rod 44 moves between a retracted position, shown in FIG. 4A, and an extended position, shown in FIGS. 3, 4D, and 6. The length of the stroke of the cylinder rod 44 is predetermined, but it may be varied if needed to obtain the proper location of the pan assembly 24 at both the receiving position and the dumping position.

Figure 13:
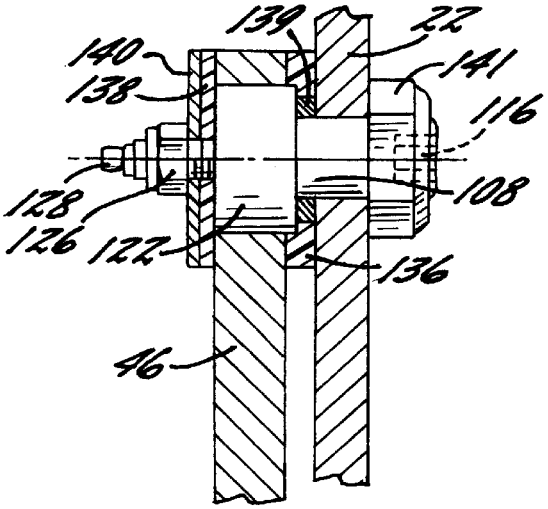
FIG. 13 is an enlarged cross-sectional view of one side of the connection of the guide arm and the frame.
Figure 14:
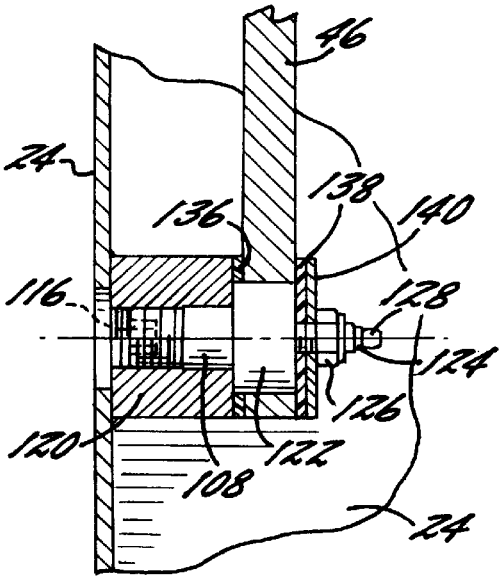
FIG. 14 is an enlarged cross-sectional view of the connection of one side of the guide arm and the pan assembly.

FIGS. 3 through 6, clearly illustrate the cooperating levers. As shown in FIGS. 13 and 14, a pair of guide arms 46 are pivotally connected at a first end 46*a* to the frame 22 and pivotally connected at a second end 46*b* to the pan assembly 24. The pair of guide arms 46 are connected to the frame 22 and the pan assembly 24 at corresponding locations to ensure that the guide arms have corresponding movement between the receiving position and the dumping position. The guide arms 46 of this embodiment use a bearing assembly generally indicated as 48 in FIGS. 5 and 7 through 9.

A pair of first actuator arms 50 are pivotally connected at a location between a first end 50*a* and a second end 50b to the upper end of the cylinder rod 44. As shown in FIGS. 3, 4A through 4D, and 5, the upper end of the cylinder rod 44 includes a eye 52 which surrounds a spherical bearing 54 having characteristics similar to bearing number 7SF-TT manufactured by Torrington. In this embodiment the eye 52 is connected to the first pair of actuator arms 50 approximately one-third the distance from the first end 50*a* to the midpoint of the pair of first actuator arms. Adjacent eye 52 are two washers 56 which separate the eye 52 from a pair of bushings 58 fixedly attached to the first actuator arms 50 by means of welding. A first pivot pin 60 passes through the pair of bushings 58, the washers 56, spherical bearing 54 and into corresponding first apertures 62 formed in the pair of first actuator arms 50. The first end 50A of each of the first actuator arms 50 is fixedly attached to a first pivot shaft 64 which extends between and is pivotally attached to the side members 28 of the frame 22. This configuration of the first actuator arms 50 in combination with the cylinder rod 44 and the first pivot shaft 64 enables the first actuator arms to move between the receiving position and the dumping position in response to movement of the cylinder rod 44 between its retracted position and its extended position.

A pair of second actuator arms 66 are attached at a first end 66*a* to a second pivot shaft 68 in a manner similar to that of the first pivot shaft, i.e. by conventional means such as welding. A second end 66*b* of the second actuator arms 66 are pivotally connected to the pan assembly 24 by a cam bearing 70 inserted through apertures 71 of the second ends 66*b* and threadingly secured into block 72. As may be seen in FIGS. 3 and 6, the second actuator arms 66 are connected to the pan assembly 24 at a location which is higher than the connection point of the guide arms 46 when the pan assembly 24 is in the receiving position.

Figure 5:
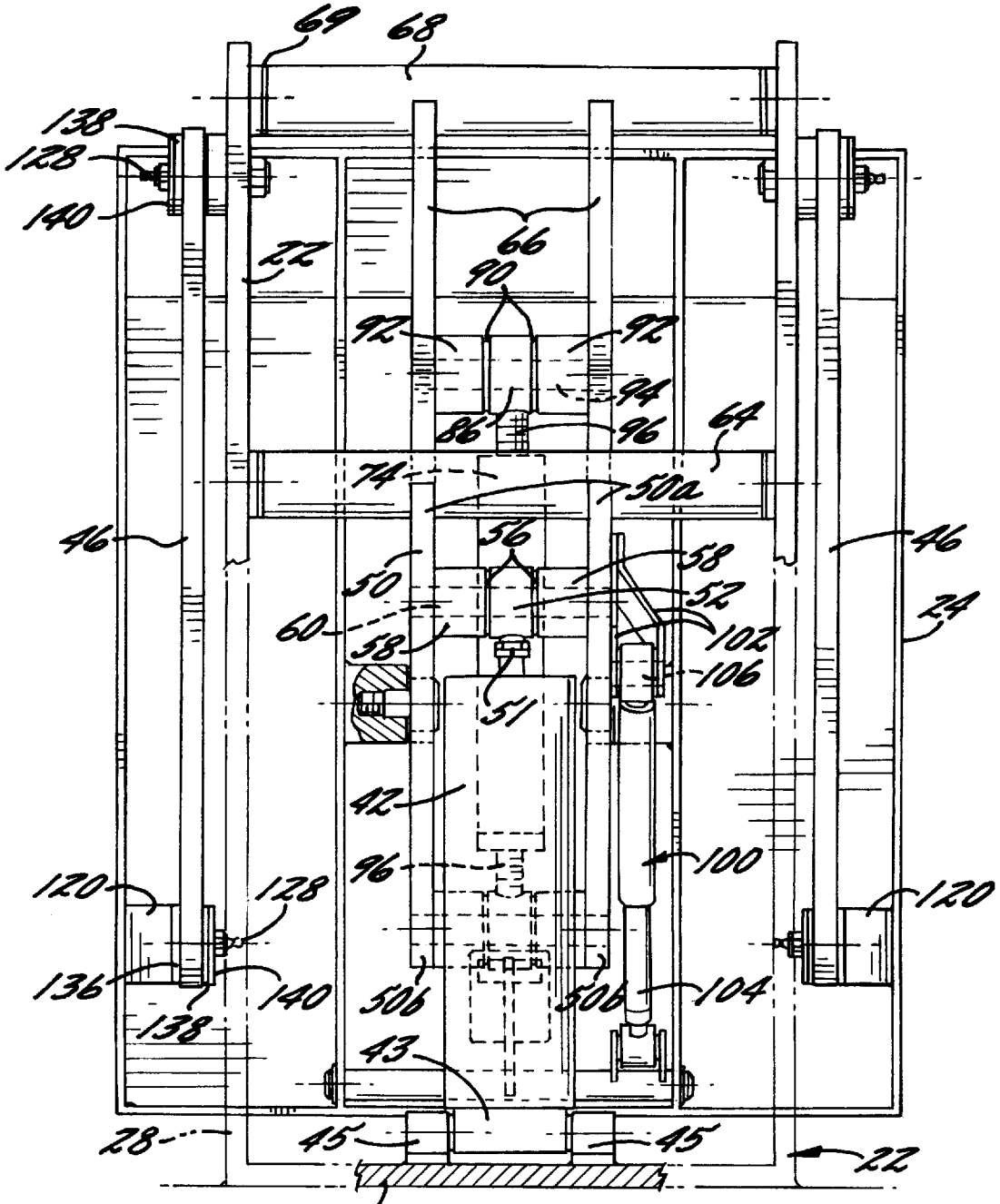
FIG. 5 is a rear view partially in phantom showing the lift mechanism when in the receiving position.

A connecting arm 74 is attached at a first end 74*a* to the second end 50*b* of the first actuator arms 50 by means of a second eye 76, a second spherical bearing 78, a second pair of washers 80, a second pair of bushings 82, and a second pivot pin 84 in a manner identical to that previously described with respect to the pivotal connection of the cylinder rod 44 to the first actuator arms 50 adjacent the first end 50*a* thereof. A second end 74*b* of the connecting arm 74 is pivotally connected to a midpoint between a first end 66*a* and a second end 66*b* of the second actuator arm 66 by means of a third eye 86, a third spherical bearing 88, a third pair of washers 90, a third pair of bushings 92, and a third pivot pin 94 in a manner identical to that previously described with respect to the first end 74*a*. As shown in FIG. 5, the first end 74*a* and the second end 74*b* of the connecting arm 74, have threaded shafts 96 which allow the connecting arm to be adjustable so as to adjust the dump angle of the pan assembly 24 when in the dumping position and the closed angle of the pan assembly when in the receiving position as shown in FIGS. 2 and 4A.

As shown by comparing FIGS. 4A–4D, once the lip CC of the cart BB has engaged the upper hanger 34 of the face plate 32, hydraulic fluid is introduced into the cylinder 42 by means of an inlet aperture 98 and an outlet aperture 109. This hydraulic fluid initiates the linearly reciprocal motion of the cylinder rod 44, causing the cylinder rod to move from its retracted position shown in FIG. 4A toward its extended position shown in FIG. 4D. As the cylinder rod begins to extend, a second end of the cylinder rod exerts a linear force through the first pivot pin 60 onto the first actuator arm 50 causing the first actuator arm to pivot with the first pivot shaft 64 from its receiving position as shown in FIG. 4A. The first pivot shaft 64 has a cam bearing 65 located at each end thereof to allow the first pivot shaft to rotate or pivot relative to the frame 22 in response to the movement of the first actuator arm 50.

Figure 12:
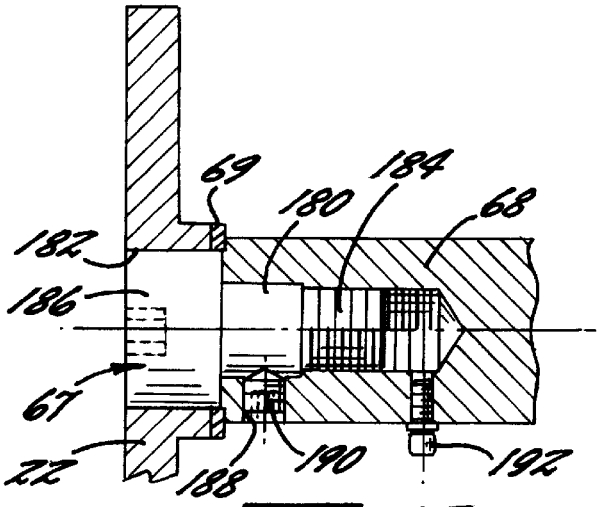
FIG. 12 is an enlarged cross-sectional view of one side of the connection of the second pivot shaft and the frame.

As the first actuator arm 50 continues to move upward as a result of continued linear movement of the cylinder rod 44, the second end 50*b* of the first actuator arm begins to move away from the frame 22 as shown in FIG. 4B. This movement of the first actuator arm 50 results in upward pressure being exerted on the connecting arm 74. This upwardly linear force is transferred to the second actuator arm 66 at the connection point of the connecting arm and the second actuator arm. Such force causes the second actuator arm 66 to begin to pivot with the second pivot shaft 68. As shown in FIG. 12, the second pivot shaft 68 also has a cam bearing 67, such as a McGill bearing, located at each end thereof to allow the second pivot shaft to rotate or pivot relative to the frame 22 against a ultra heavy modular weight "UHMW" thrust washer 69 positioned between the second pivot shaft and the frame. The cam bearing 67 has a threaded body 180 which projects into a threaded bore 182 in the second pivot shaft 68. A cam follower 184 is located on the threaded body 180 to cooperate with a bearing 186 located within the frame 22. A set screw 188 is received in another threaded bore 190 located generally transverse to threaded bore 182 to prevent the cam bearing 67 from unscrewing. A grease zerk 192 is located in fluid communication with the threaded body 180 to ensure lubrication thereof and the bearing 67.

As may be seen by comparing FIGS. 4A and 4B, at the onset of linear movement of the cylinder rod 44, a base 43 of the cylinder 42 pivots about mounts 45 to enable the actuator 26 to pivot outward away from the frame 22 ensuring that maximum force is transferred to the first actuator arms 50. As the cylinder rod 44 continues to move toward its extended position, the first actuator arms 50 and the second actuator arms 66 have corresponding movement as a result of connecting arm 74. Comparing FIGS. 4A through 4D, it may be seen that the guide arms 46 and the second actuator arms 66 actually cross over one another or scissor relative to each other as they move from the receiving position to the dumping position.

As the pan assembly 24 begins to be lifted upward above the ground and rotated outward relative to the frame 22, a smaller second linearly reciprocating actuator 100, pivotally mounted at one end thereof to the second actuator arm, by a mounting block 102, begins to extend its cylinder rod 104 causing the lower latch 40 to rotate about a pivot cam bearing 106 outward so as to engage the catch bar DD to retain the cart BB when it is inverted in the dumping position. The cylinder rod 104 of the second actuator 100 is spring biased outward so that in the receiving position, the cylinder rod is fully extended thereby retracting the lower latch 40. However, as the pan assembly 24 begins to pivot outward away from the frame 22 the cylinder rod 104, which is attached to the second actuator arm 66 is compressed as the orientation of the pan assembly 24 changes relative to the second actuator arm, causing compression of the cylinder rod. This compression in turn results in the extension of the lower latch 40 as the pan assembly 24 approaches the dumping position.

As the cylinder rod 44 continues upward toward its extended position to thereby locate the pan assembly 24 in the dumping position shown in FIG. 4D, a limiting means is used to smoothly slow the arcuate movement of the first actuator arms 50. The limiting means of this embodiment is a shock absorber 101 mounted by a cross member or mounting bracket 103 to a beam 105 which extends between side members 28. The shock absorber 101 presses against a cross bar 107 to be activated and slow the first actuator arms 50. The shock absorber 101 may be adjustable so that the speed of the stop of the first actuator arms 50 may easily be adjusted in the field. The shock absorber 101 of this embodiment, is of a type similar to that available by Endine® as part number LROEM 3/4×2.

The beam 105 has a generally rectangular cross-sectional configuration and is secured to the side members 28 by conventional means such as welding. Similarly, the cross bar 107 has a similar configuration and is correspondingly positioned to span the first actuator arms 50. The beam 105 and the cross bar 107 are each oriented so as to position the shock absorber 101 to engage the first actuator arms 50, as they move toward the dumping position, to prevent over rotation of the pan assembly 24.

As shown, the shock absorber 101 and the cross bar 103, in combination with an internal dampener (not shown) located in each end of the actuator 26, ensures that the speed of the pan assembly 24 has sufficiently slowed so that as the actuator 26 reaches the end of its stroke i.e., the extended position, the pan assembly will not come to an abrupt stop and cause possible damage to the lift mechanism 20. Instead, because of the shock absorber 101 and the internal dampener, the pan assembly 24 comes to a smooth stop under control and without damaging either the cart BB or the lift mechanism 20 and minimizing any excessive wear on the lift mechanism.

As previously discussed, it is possible to adjust the threaded shaft of each of the first end 74*a* and the second end 74*b* of the connecting arm 74 to ensure the desired dump angle, in this instance approximately 45° from horizontal, of the pan assembly. In addition, an eye 51 of the cylinder rod 44 may also be adjusted to adjust the travel of the pan assembly to ensure that it travels as sufficient distance into the hopper of the refuse collection vehicle AA.

The guide arms 46 pivot relative to the frame 22 to guide the pan assembly and ensure proper rotational alignment thereof throughout its movement. It is the cooperation between the frame 22, the first pivot shaft 64, the second pivot shaft 68 and corresponding movement between the first actuator arms 50 and the second actuator arms 66 through connecting arm 74 which ensures both a smooth and torsionally rigid movement of the pan assembly 24 between the receiving position and the dumping position.

The guide arms 46 of this embodiment rely on the bearing assembly 48 for pivotal movement between the receiving position and the dumping position.

As shown in FIGS. 7–9 and 14, the bearing assembly used to pivotally connect the guide arms 46 and the pan assembly 24 includes a generally cylindrical body portion generally indicated as 108 having a shoulder 110 located adjacent at first end and a cylindrical rib 112 spaced from the shoulder. The body portion 108 also includes a threaded turning end 114, which in this embodiment, defines a cavity 116 for receiving a driver such as an allen wrench or a screwdriver to threadingly mount the body portion within a correspondingly threaded bore 118 in a mounting block 120 formed in or welded to the pan assembly 24. Rather than defining a cavity 116 within the turning end 114, it is also possible to provide a male end to cooperate with a driver such as a wrench for threadedly mounting the body portion 108 into the threaded bore 118 of block 120. A bearing 122 is seated on the body portion 108 between the shoulder 110 and the cylindrical rib 112. In this embodiment, the bearing 122 is a needle bearing having a crowned outer race to accommodate for misalignment of the guide arm 46 relative to the block 120 and to accommodate for torsional forces applied to the guide arms 46. A threaded shaft 124 extends outward from the body portion 108 adjacent the shoulder 110. The threaded shaft 124 receives a threaded fastener such as a nut 126 thereon. A second bore 128 receives a drive type grease valve or zerk 130 which is press fit therein. The grease valve 130 is, through the bore 128, in fluid communication with a cylindrical aperture 132 located in the body portion 108 between the shoulder 110 and a rib 112. This configuration of the grease valve 130 and the cylindrical aperture 132 ensure that needles 134 of the bearing 122 remain lubricated. A second lubricating aperture 133, in fluid communication with the bore 128, is located on the body portion 108 adjacent the threaded end 114 to lubricate a portion of the threaded bore 118.

Once the threaded end 114 of the body portion 108 has been threadingly received within the threaded bore 118 of the block 120, a first ultra heavy molecular weight ("UHMW") thrust washer 136 is positioned over the body portion 108 and against the block 120. The guide arms 46 are then positioned over the body portion and onto the bearing 122. A second UHMW thrust washer 138 is then positioned over the threaded shaft 124 into abutment with the shoulder 110. A steel retainer plate 140 is then positioned adjacent to and in frictional engagement with the second thrust washer as the threaded fastener 126 is threadingly received on the threaded shaft 124 to ensure that the guide arms 46 are pivotally connected to the pan assembly 24 while remaining positioned over the bearing 122. A similar arrangement occurs to pivotally connected the first end 46*a* of the guide arms to the frame 22. However, in such configuration, rather than utilizing block 120, the body portion is threadingly received directly within a threaded aperture 142 located in the side members 28 of the frame 22.

A similar bearing assembly 48 is illustrated in FIG. 13 to connect the guide arms 46 to the frame 22. In this configuration, a steel spacer 139 is positioned between the bearing 122 and the frame. In addition, an additional nut 141 is threaded onto the threaded end 144 to secure the body portion 10 into the frame 22. In all other respects this bearing assembly 48 operates the same as previously described with respect to FIGS. 7–9 and 14.

Figure 10:
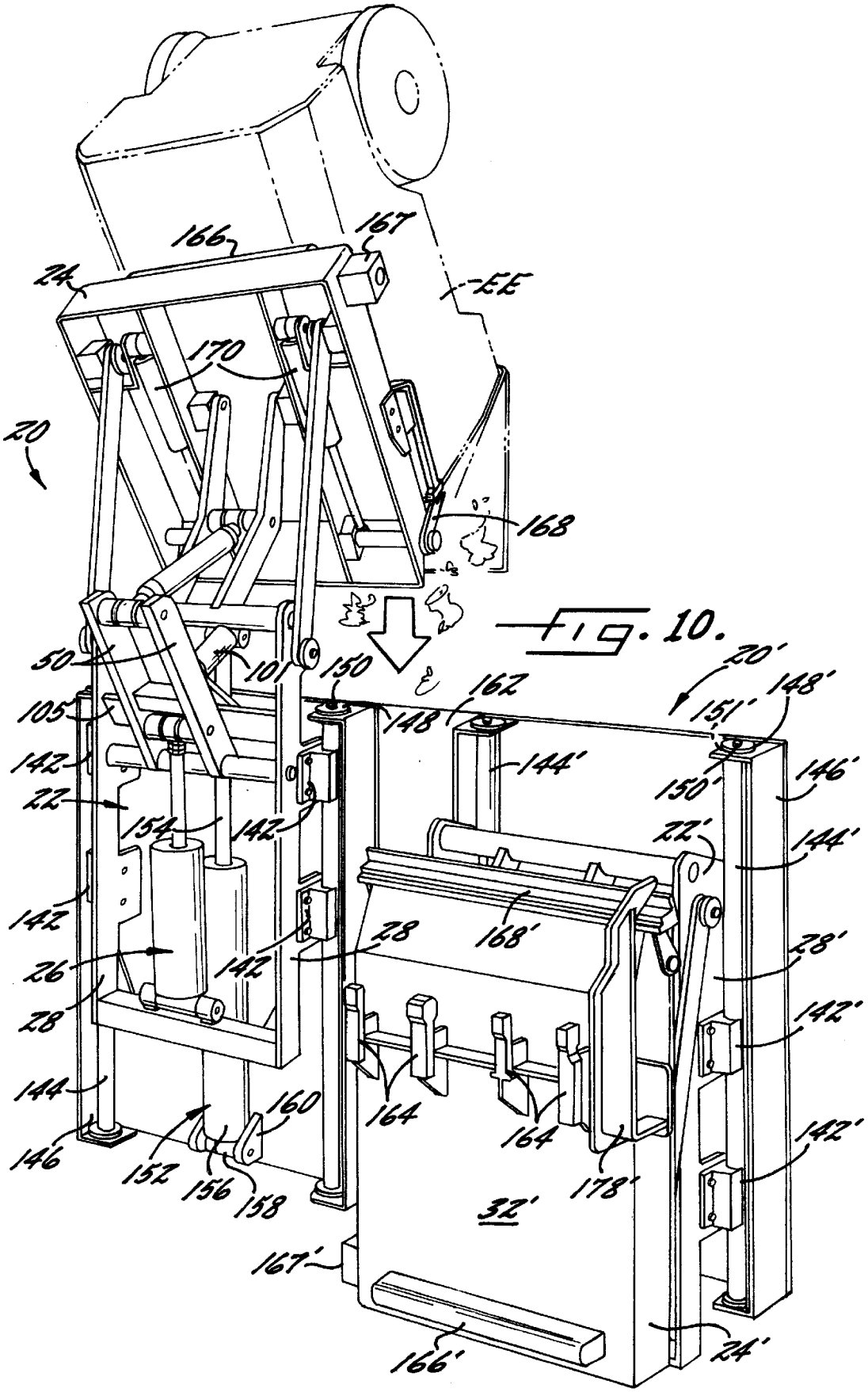
FIG. 10 is a view of an alternative embodiment of the present invention showing a pair of lift mechanisms operating independent of one another in accordance with the present invention.
Figure 11:
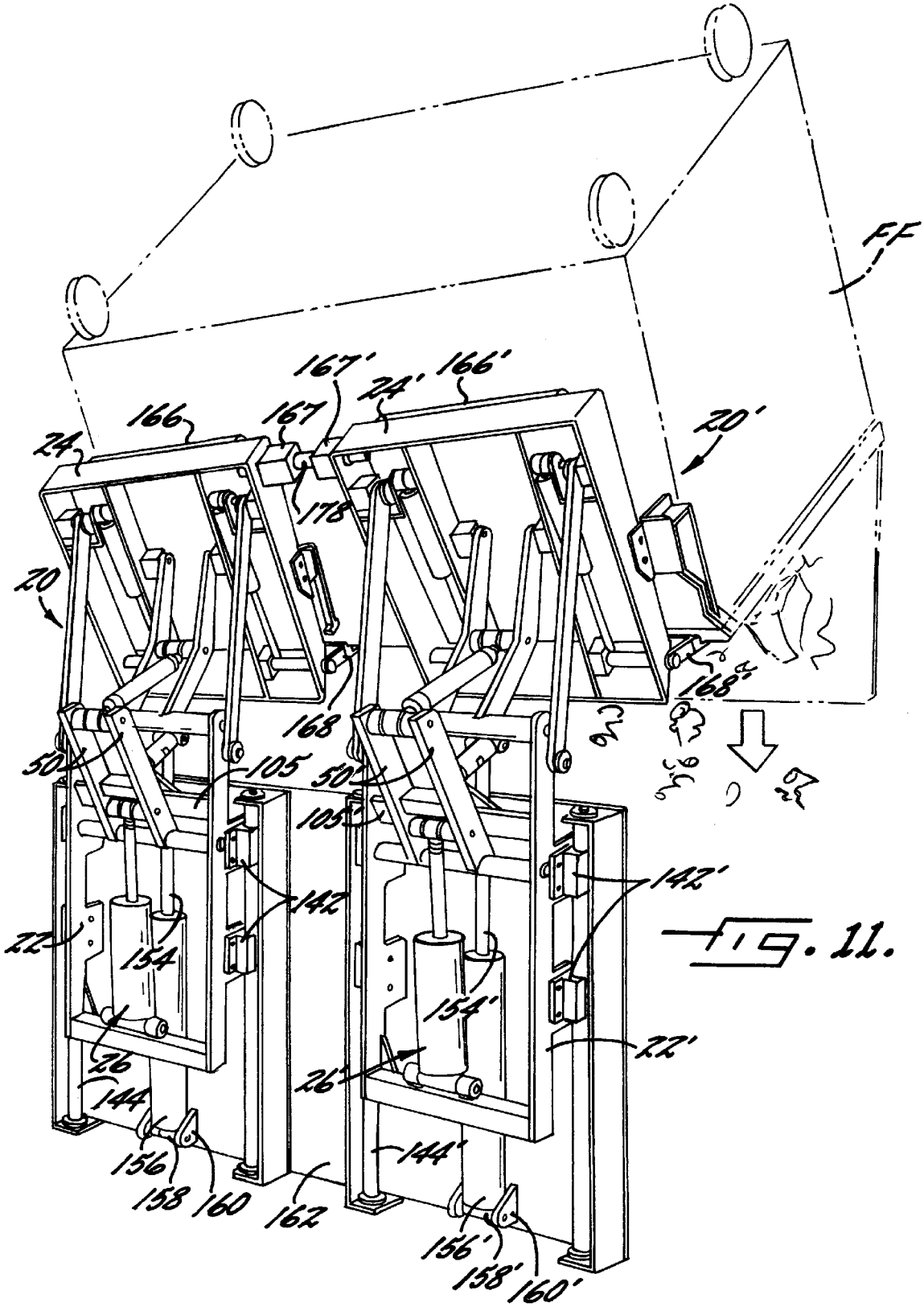
FIG. 11 is a side view and perspective of both lift mechanisms shown in FIG. 10 working in unison in the dumping position to dump a commercial cart.

FIGS. 10 and 11 illustrate an alternative embodiment of the present invention. In FIG. 10, a second lift mechanism 20' is positioned adjacent the first lift mechanism 20. Where possible in the description below, the elements of the alternative embodiment of the lift mechanism 20 will be described without reference to the second lift mechanism 20'. It is to be understood, however, that the second lift mechanism 20' contains the same elements and operates in the same manner as described for the alternative embodiment of the lift mechanism 20.

The frame 22 of the lift mechanism 20 is attached by a pair of linear pillow blocks 142 which are attached on each side member 28 of the frame 22 to a pair of round slide rails 144. The slide rails 144 are attached to a pair of pillow blocks 146 by conventional means such as a washer 148, a threaded screw 150 and a bushing 151 which accommodates for any misalignment therebetween. The pair of pillow blocks 146 are each secured to the refuse collection vehicle AA by conventional means such as bolting or welding. A third linear reciprocating actuator 152 having a cylinder rod 154 moveable between a retracted position, shown in FIG. 10 by the second lift mechanism 20', and an extended position, shown in FIG. 10 by the first lift mechanism 20. The third actuator 154 has a cylinder 156 which is pivotally connected at a base portion 158 to mounts 160 which are directly connected to the refuse collection vehicle AA. Alternatively, a mounting panel 162 may be used to secure the housing brackets 146 thereto forming an integral unit which is in turn attached to the refuse collection vehicle AA as a single unit.

The purpose of the third actuator 152 is to move the frame 22 directly upward above the ground before the first actuator 26 initiates movement of the pan assembly 24 between the receiving position and the dumping position. By using the slide rails 144 and the third actuator 152 to elevate the frame 22 before activating the first actuator 26, results in the ability of the refuse collection vehicle to operate in narrower confines such as in alleyways or on narrow European roads.

In the embodiment shown in FIG. 10, the face plate 32 utilizes an alternative engaging system to that described in FIGS. 1–6. In this embodiment, rather than utilizing an upper hanger 34 and a lower latch 40, a European standard DIN system is used whereby the plurality of upstanding combs 164 are used to engage the lip of an European refuse cart EE. Similarly, rather than using a pair of pads 41, a generally rectangular pad 166 is used so as to be oriented generally transverse a longitudinal axis of the face plate 32. The combs 164 cooperate with a pivotal upper latch 168 to secure the lip of the European cart EE. The upper latch 168 utilizes a pair of fourth linearly reciprocating actuators 170 which are activated by a limit switch (not shown) to cause the upper latch 168 to move from a release position, shown in FIG. 10 by the second lift mechanism 20', to an engaged position as shown in the first lift mechanism 20. The limit switch causes the activation of the fourth actuators 170 once the frame 22 has been raised on the slide rails 114 at any predetermined height above the ground. By so doing, the refuse cart EE is secured into engagement with the face plate 26 once it has been raised eight inches, thereby minimizing the potential for separation of the cart from the face plate. In addition, when in the engaged or locked position, the upper latch 68 prevents the container EE from moving away from the face plate 32 when the pan assembly is in the dumping position as shown by the first lift mechanism 20 in FIG. 10.

As previously described in the context of the embodiment shown in FIGS. 1 through 6, as the first actuator 26 begins to pivot the first pair of actuator arms 50 upward, the shock absorber 101 positioned on the cross beam 105 slows down the speed of the first pair of actuator arms 46 along their arcuate path to ensure that the pan assembly 24 comes to a smooth stop in the dumping position.

As shown in FIG. 10, it is possible for the first lift mechanism 20 to operate independently of the second lift mechanism 20' in order that residential carts EE may be independently received and dumped. Alternatively, as shown in FIG. 11, it is possible to have the first lift mechanism 20 and the second lift mechanism 20' operate in unison to lift a larger commercial container FF. In order to operate in unison, a connecting bar 178 is moved from the second lift mechanism 20' into a corresponding aperture formed in a pair of corresponding blocks 167 of the first and second lift mechanisms 20 and 20'. In addition, a larger upwardly extending comb 178 located on opposed external surfaces of the first lift mechanism 20 and the second lift mechanism 20' cooperate with the combs 164 and the upper latch 168 to engage sides of the container FF. In all other respects, the lift mechanisms 20 and 20' illustrated in FIGS. 10 and 11 contain the same elements and operate in the same manner as previously described with respect to the preferred embodiment in FIGS. 1–6.

A second alternative embodiment of the invention is disclosed in FIGS. 15–19. In this embodiment, a lift mechanism 220 is intended to be mounted to a refuse collection vehicle AA'. In this instance, the lift mechanism 220 is mounted on the refuse collection vehicle AA' as a rear loader. It is to be understood however, that the lift mechanism 220 may also be used as a front loading device, a side loading device or a free standing device.

As shown, the lift mechanism 220 includes a frame, generally designated as 222, which attaches to the refuse collection vehicle AA' by conventional means such as by bolting or welding. The lift mechanism 220 also includes a movable pan assembly, generally designated as 224 and a linearly reciprocating actuator, generally designated as 226.

Figure 16:
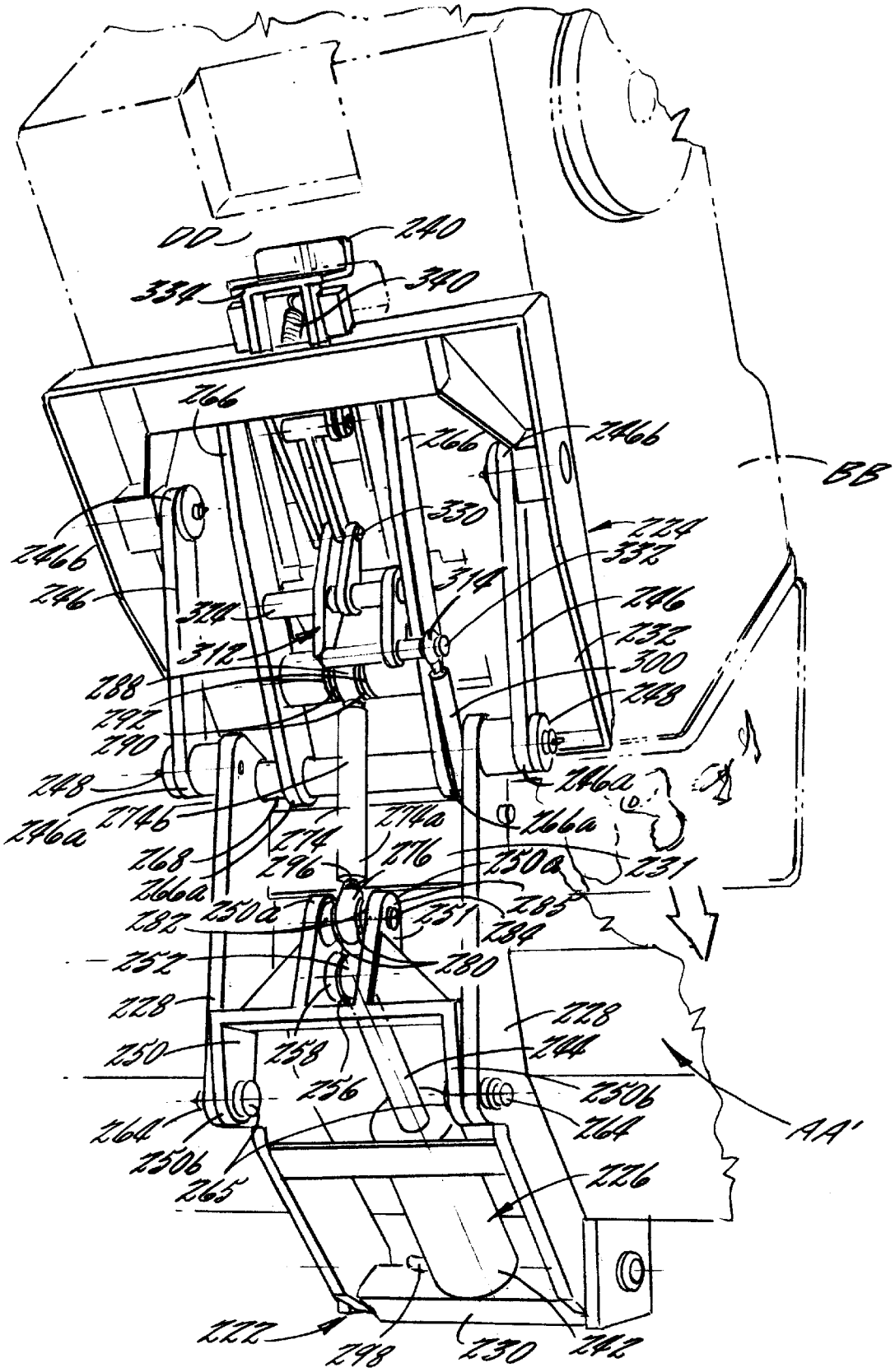
FIG. 16 is a side view in perspective of the lift mechanism shown in FIG. 15 in the dumping position.
Figure 17A:
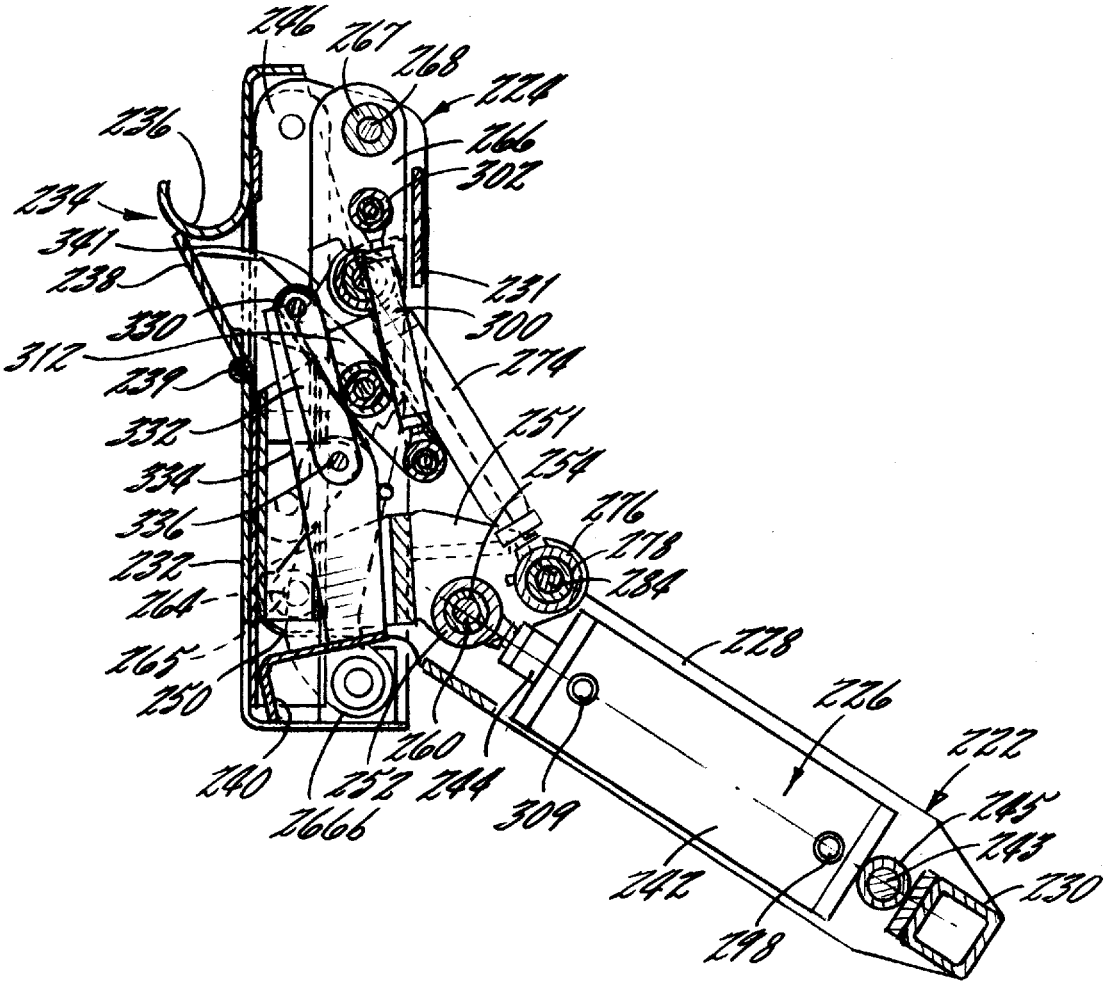
FIGS. 17A–17C is a series of side views of the lift mechanism as it moves from the receiving position to the dumping position.
Figure 17B:
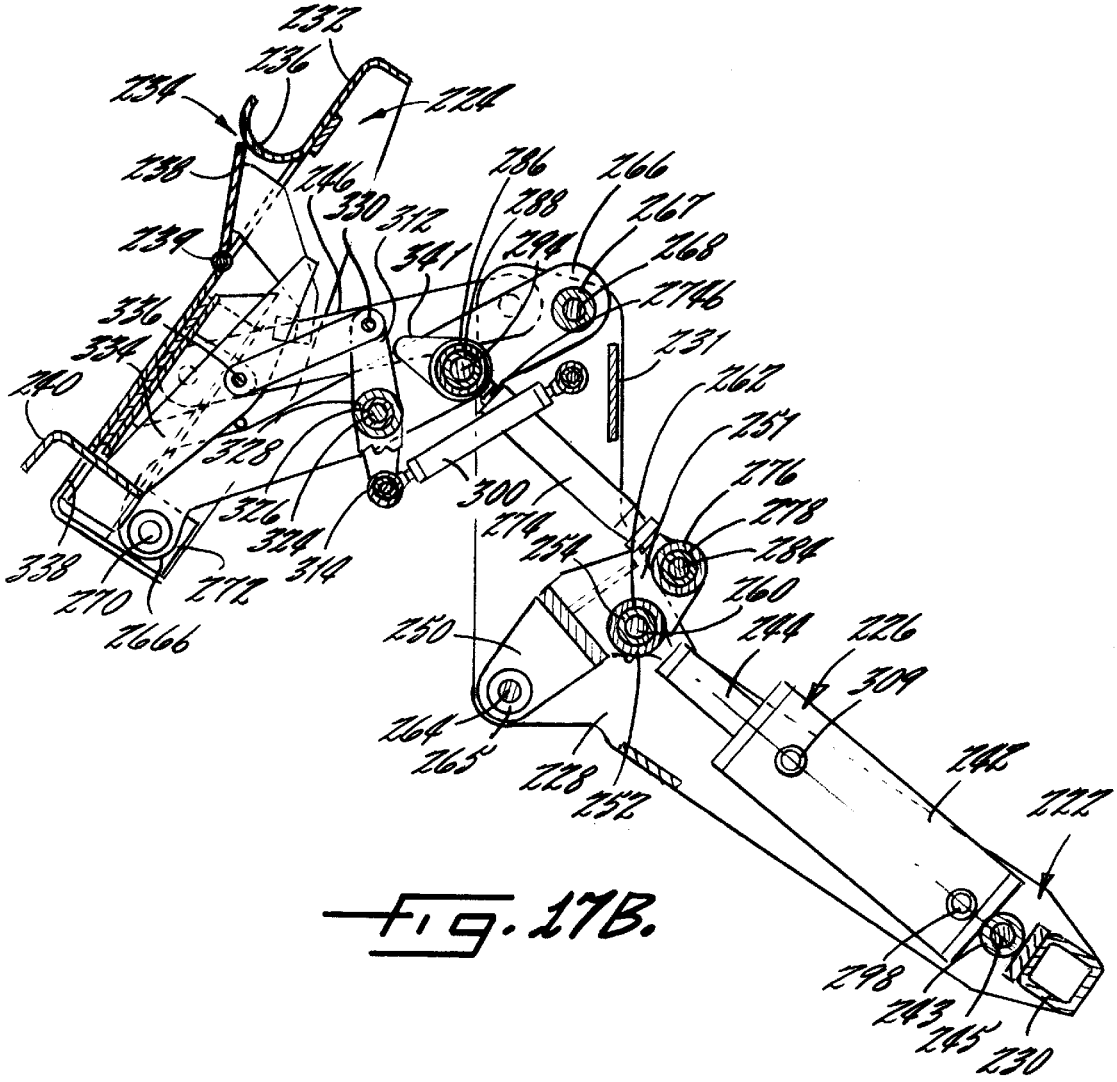
Figure 17C:
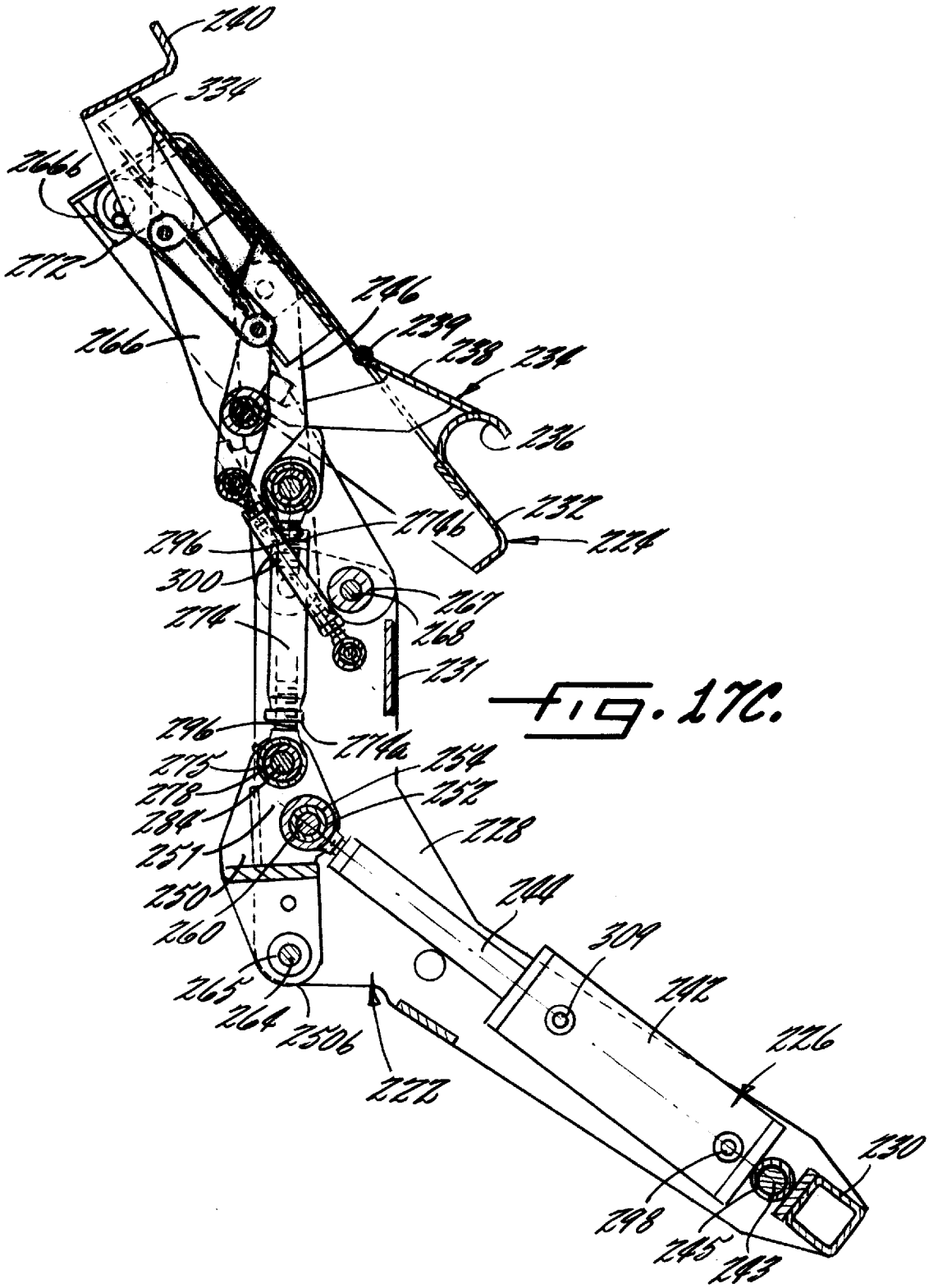
Figure 18:
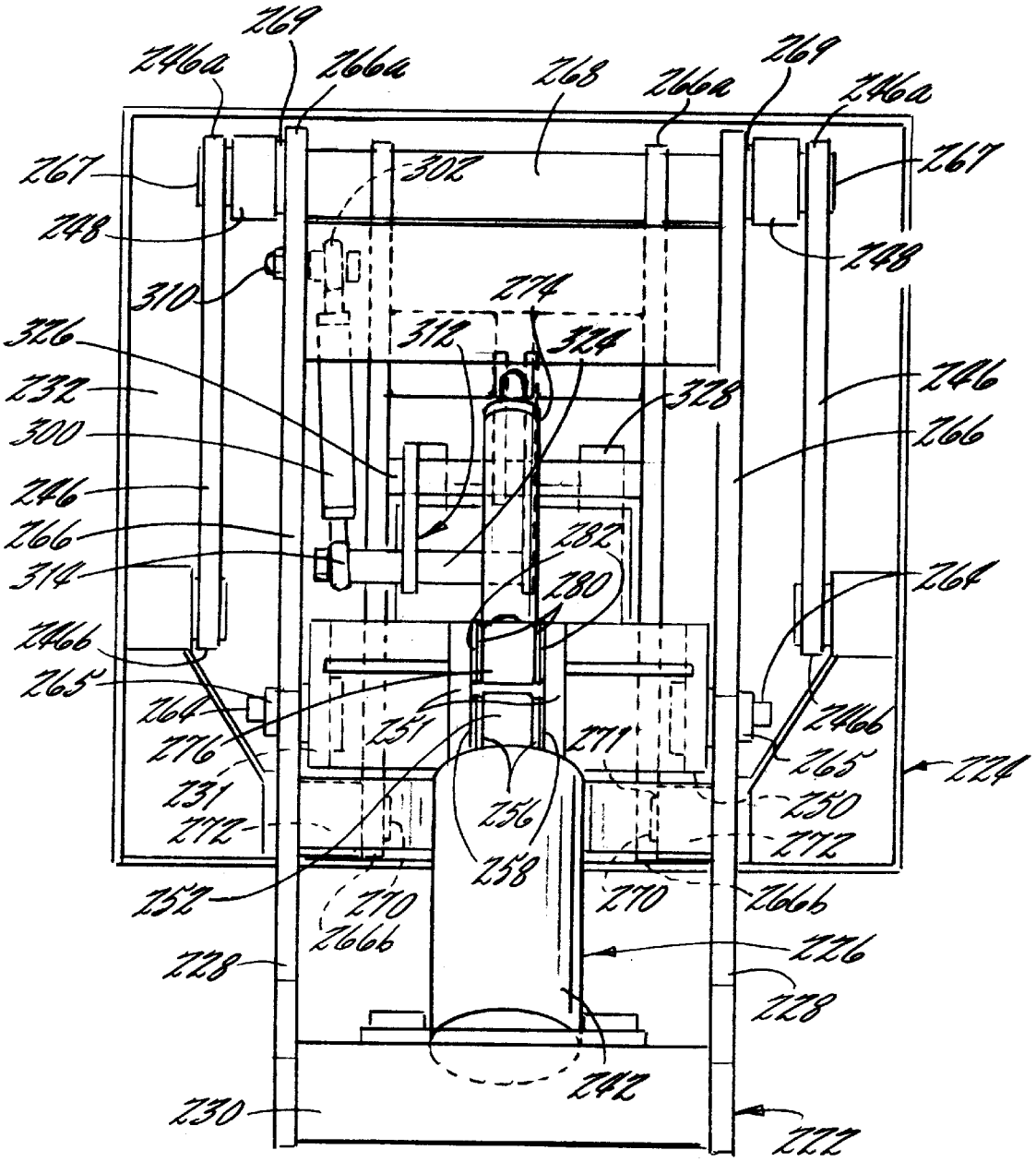
FIG. 18 is a rear view partially in phantom showing the lift mechanism when in the receiving position.

The frame 222, as best shown in FIGS. 16–18, has a generally L-shaped configuration when seen in side view. The frame 222 is formed from a pair of side members 228 which are joined by a bottom member 230. Each of the frame members 228 and 230 have a generally rectangular cross-section. It is to be understood however, that the cross-sectional shape of the frame members may vary significantly and remain within the spirit of the invention so long as the frame members are constructed from a gauge of steel which ensures that the lift mechanism 220 is torsionally stable and capable of supporting substantial weight. The frame 222 forms a generally H-shaped configuration and, in this configuration, is attached to the refuse collection vehicle AA' along back edges of the side members 228, along the bottom of the bottom member 230, and by means of a mounting plate 231 extending between the side members, and longitudinally spaced from the bottom member. Alternatively, the frame 222 may form a portion of the refuse collection vehicle AA' and a series of supports (not shown) will be used to retain and support elements of the lift mechanism 220.

Figure 15:
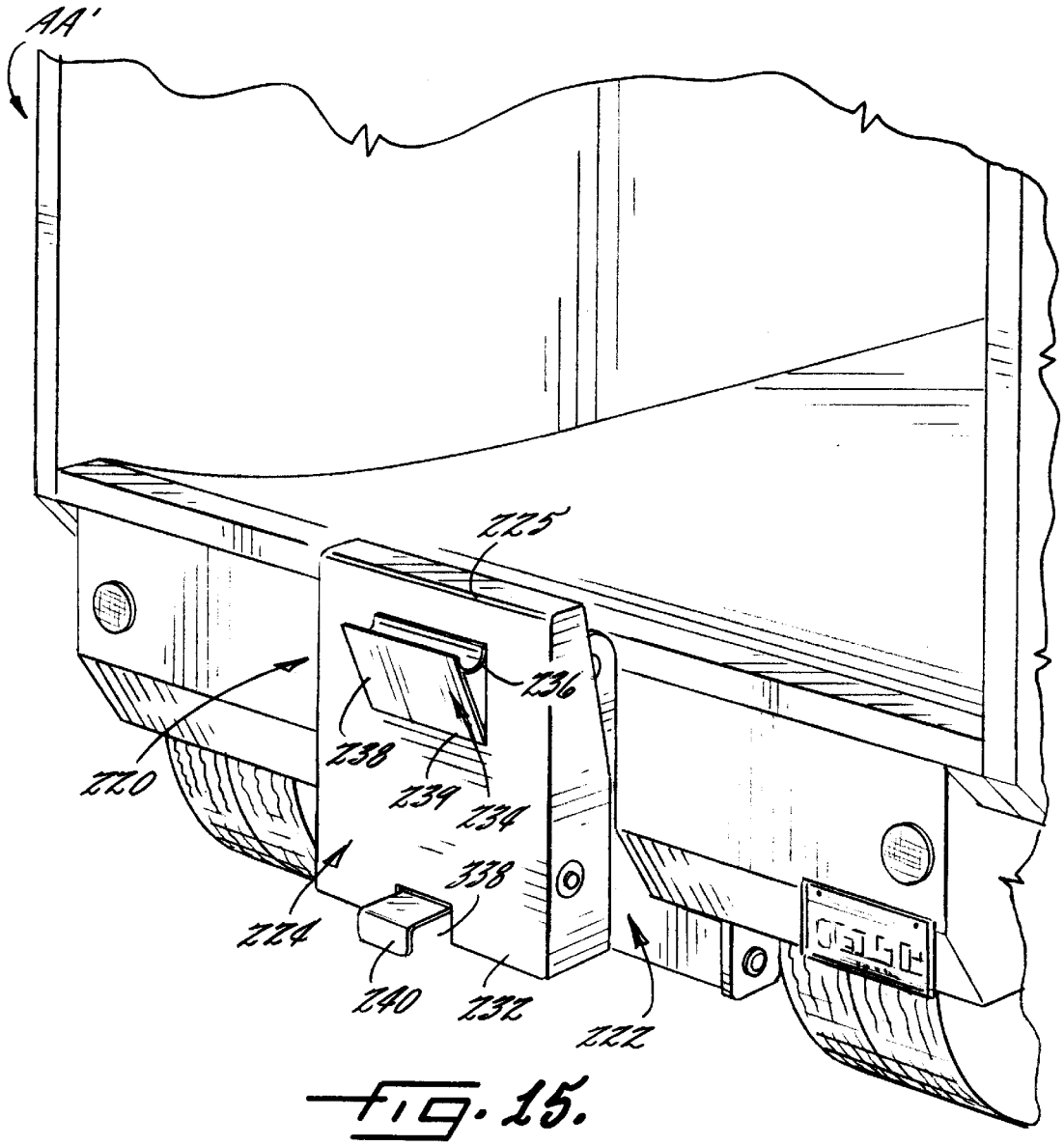
FIG. 15 is an end view in perspective of a portion of the refuse collection vehicle utilizing an alternative embodiment of the lift mechanism in accordance with the present invention.

The pan assembly 224 is best shown in FIGS. 15 through 18. As shown in FIG. 15, the pan assembly 224 has a generally rectangular configuration having a substantially flat bottom and sides, and a rounded upper edge portion 225 adjacent the top of the pan assembly. The pan assembly 224 also includes a face plate 232 which has an variety of possible engagement means to engage and releasably retain one of a plurality of different refuse carts, generally designated as BB. As previously discussed in the context of the previous embodiments, the refuse cart BB shown, is a domestic or U.S. residential cart. Accordingly, the configuration of the face plate 232 must be such that the cart BB can be easily engaged and retained by the pan assembly 224. As in the previous embodiments, the face plate 232 has an upper hanger 234 which, as shown in FIG. 15, engages the lip CC to ensure that the cart BB is securely seated on the hanger 234 prior to movement of the pan assembly 224 from a receiving position as shown. In this embodiment of the invention, the receiving position and the stowed position—the position of the lift mechanism when not in use, i.e., in between lifting cycles and prior to movement away from the refuse collection vehicle, are the same.

The upper hanger 234 of this embodiment is formed from a generally U-shaped seat 236, a support member 238, and a hinge 239. The seat 236 and the support member 238 are cooperatively pivotable about hinge 239 relative to the face plate 232 in order to limit any damage to the upper hanger in the event that the refuse collection vehicle AA' backs up into a solid object such as a commercial refuse container FF (see FIG. 11). A lower latch 240 is used to engage a catch bar DD formed in the cart BB to ensure that the cart, when in the dumping position, shown in FIG. 16, remains solidly secured on the face plate 232. In this embodiment, because the catch bar DD has a generally rectangular cross-sectional configuration, the lower latch 240 has a corresponding shape, in this case, a generally L-shaped configuration to make sure that the cart BB remains on the pan assembly 224 when inverted. It is to be understood that the shape of the lower latch 240 may vary significantly and still remain within the spirit of the invention. This is especially true since many of the catch bars used on other refuse carts BB are round. Although not shown, pads similar to that discussed above with reference to the prior embodiment, may be attached to the face plate 232 on either side of the lower latch 240 to protect the cart BB from damage.

To move the pan assembly 224 from a receiving position to a dumping position, as shown in FIGS. 17A through 17C, requires the use of the reciprocating actuator 226 and a series of cooperating levers which, in conjunction with the frame 222 and the pan assembly 224, form a series of four-bar linkages.

In this embodiment, the reciprocating actuator 226 is a hydraulic cylinder which has a cylinder 242, into which a cylinder rod 244 moves between a retracted position, shown in FIG. 17A, and an extended position, shown in FIGS. 16 and 17C. The length of the stroke of the cylinder rod 244 is predetermined, but it may be varied if needed to obtain the proper location of the pan assembly 224 at both the receiving position and the dumping position. In this embodiment, the cylinder rod or second end 224 of the reciprocating actuator 226 has a 6" stroke.

FIGS. 16 through 18, clearly illustrate the cooperating levers which form the four bar linkages. As shown in FIGS. 16 and 17B, a pair of guide arms 246 are pivotally connected at a first end 246*a* to the frame 222 and pivotally connected at a second end 246*b* to the pan assembly 224. The pair of guide arms 246 are connected to the frame 222 and the pan assembly 224 at corresponding locations to ensure that the guide arms have corresponding movement between the receiving position and the dumping position. The guide arms 246 of this embodiment use a bearing assembly 248. A detailed discussion of this bearing assembly, (identified as 48) is set forth above in the context of the previous embodiments of the invention (see FIGS. 5 and 7 through 9). The guide arms 246 pivot relative to the frame 222 to guide the pan assembly and ensure proper rotational alignment thereof throughout its movement.

A first actuator arm 250 is pivotally connected at a location between a first end 250*a* and a second end 250*b* to the upper end of the cylinder rod 244. As shown in FIGS. 16, 17A through 17C, and 18, the first actuator arm 250 has a generally U-shaped configuration, in front view, with an upwardly extending collar 251 formed in the first end 250*a* thereof. As shown, the first actuator arm 250 is connected via the collar 251 to the upper end of the cylinder rod 244, which includes a eye 252 surrounding a spherical bearing 254, having characteristics similar to bearing number 7SF-TT manufactured by Torrington. Adjacent eye 252 are two washers 256 which separate the eye 252 from a pair of bushings 258 fixedly attached to the first actuator arm 250 by means of welding. A first pivot pin 260 passes through the pair of bushings 258, the washers 256, spherical bearing 254 and into corresponding first aperture 262 formed in the collar 251 of the first actuator arm 250. A second end 250*a* of the first actuator 250 is pivotally connected to the frame 222 by means of first pivot pin 264. It is this cooperation of the first pivot pin 264 and the cylinder rod 244 which enables the first actuator arm 250 to move between the receiving position and the dumping position in response to movement of the cylinder rod 244 between its retracted position and its extended position.

A pair of second actuator arms 266 are attached at a first end 266*a* to a pivot shaft 268 by conventional means such as welding. A second end 266*b* of the second actuator arms 266 are pivotally connected to the pan assembly 224 by a cam bearing 270 inserted through apertures 271 of the second ends 266*b* and threadingly secured into block 272. As may be seen in FIGS. 17A and 18, the second actuator arms 266 are connected to the pan assembly 224 at a location which is lower than the connection point of the guide arms 246 when the pan assembly 224 is in the receiving position.

A connecting arm 274 is attached at a first end 274*a* to the second end 250*b* of the first actuator arm 250 by means of a second eye 276, a second spherical bearing 278, a second pair of washers 280, a second pair of bushings 282, and a second pivot pin 284 fitted into a second aperture 285 formed in the collar 251, in a manner identical to that previously described with respect to the pivotal connection of the cylinder rod 244 to the first actuator arm 250. A second end 274*b* of the connecting arm 274 is pivotally connected to a midpoint between a first end 266*a* and a second end 266*b* of the second actuator arm 266 by means of a third eye 286, a third spherical bearing 288, a third pair of washers 290, a third pair of bushings 292, and a third pivot pin 294 in a manner identical to that previously described with respect to the first end 274*a*. As shown in FIGS. 16 and 17C, the first end 274*a* and the second end 274*b* of the connecting arm 274, have threaded shafts 296 which allow the connecting arm to be adjustable so as to adjust the dump angle of the pan assembly 224 when in the dumping position and the closed angle of the pan assembly when in the receiving position as shown in FIGS. 15 and 17A.

As shown by comparing FIGS. 17A through 17C, once the lip CC of the cart BB has engaged the upper hanger 234 of the face plate 232, hydraulic fluid is introduced into the cylinder 242 by means of an inlet aperture 298 and an outlet aperture 309. This hydraulic fluid initiates the linearly reciprocal motion of the cylinder rod 244, causing the cylinder rod to move from its retracted position shown in FIG. 17A toward its extended position shown in FIG. 17C at a predetermined constant velocity. In this embodiment, the cylinder rod 244 completes a full reciprocating cycle, i.e., movement between the retracted position and the extended position and back to the retracted position in approximately 7 seconds. It is to be understood that this cycle time, i.e., the velocity of the cylinder rod 244, may vary significantly depending on the desire of the operator and still remain within the spirit of the invention. However, regardless of the cycle time, the movement of the cylinder rod 244 between the retracted position and the extended position according to this embodiment of the invention will be a predetermined constant velocity.

As the cylinder rod 244 begins to extend, a second end of the cylinder rod exerts a linear force through the pivot pin 260 onto the first actuator arm 250 causing the first actuator arm to pivot about the first pivot pin 264 from its receiving position as shown in FIG. 17A. The first pivot pin 264 has a cam bearing 265 to allow the first pivot pin to rotate or pivot relative to the frame 222 in response to the movement of the first actuator arm 250.

As the first actuator arm 250 continues to move upward as a result of continued linear movement of the cylinder rod 244, the second end 250*b* of the first actuator arm moves away from the frame 222 as shown in FIG. 17B. This movement of the first actuator arm 250 results in upward pressure being exerted on the connecting arm 274. This upwardly linear force is transferred to the second actuator arm 266 at the connection point of the connecting arm and the second actuator arm. Such force causes the second actuator arm 266 to pivot with the pivot shaft 268. As shown in FIG. 18, the second pivot shaft 268 also has a cam bearing 267, such as a McGill bearing, located at each end thereof to allow the pivot shaft to rotate or pivot relative to the frame 222 against a ultra heavy modular weight "UHMW" thrust washer 269 positioned between the second pivot shaft and the frame.

As may be seen by comparing FIGS. 17A and 17B, at the onset of the linear movement of the cylinder rod 244, a base 243 of the cylinder 242 pivots about mounts 245 to enable the actuator 226 to pivot outward away from the frame 222 ensuring that maximum force is transferred to the first actuator arm 250. As the cylinder rod 244 continues to move toward its extended position, the first actuator arm 250 and the second actuator arms 266 have corresponding movement as a result of connecting arm 274.

As the pan assembly 224 travels along its predetermined arcuate path relative to the frame 222, force is applied to a misaligned smaller second connecting arm 300, pivotally mounted at one end thereof to the second actuator arm 266, by means of a first spherical rod end 302. The force applied to the second connecting arm 300 is pivotally transferred through a second end thereof to a pivotally connected a lower latch actuator assembly, generally indicated as 312. The lower latch actuator assembly 312 is pivotally connected to the second connecting arm 300 by means of a second spherical rod end 314.

Continued movement of the pan assembly 224 results in the lower latch actuator assembly 312 to pivot about a pivot shaft 324 pivotally connected to and extending between the second actuator arms 266. The pivot shaft is pivotable relative to the second actuator arms by means of a cam bearing 326 and a block 328 in a manner similar to that described above relative to the first pivot shaft 268. A second end of the lower latch assembly 312 is pivotally connected by a pivot pin 330 to a lower latch linkage 332. As the pivot shaft 324 continues to turn, the lower latch linkage 332 causes movement of a slide plate 334 relative to the lower portion of the face plate 232. This movement is achieve because of a pivot pin 336 interconnecting the lower latch linkage,332 and the slide plate 334.

This cumulative movement of the above described elements results in the lower latch 240, carried by the slide plate 334 to move outward through an aperture or notch 338 in the lower portion of the face plate 232 so as to engage the catch bar DD to retain the cart BB when it is inverted in the dumping position. A spring 340 is biased outward so that in the receiving position a cam 341 on the actuator shaft 266 cams against the upper portion of the lower latch 240 to over come the bias of the spring, thereby allowing the lower latch to be retracted inside of the pan assembly 224 so that it will not be damaged if the face plate 232 accidentally is hit. If a refuse cart BB is resting against the face plate 232 this pressure will be sufficient to overcome the bias of the spring 340, again causing the lower latch to be retracted within the pan assembly. When the pan assembly 224 is in the dumping position, the spring 340 pulls the lower latch out away from the face plate 232 to address the lower bar DD of the refuse cart BB.

Figure 19:
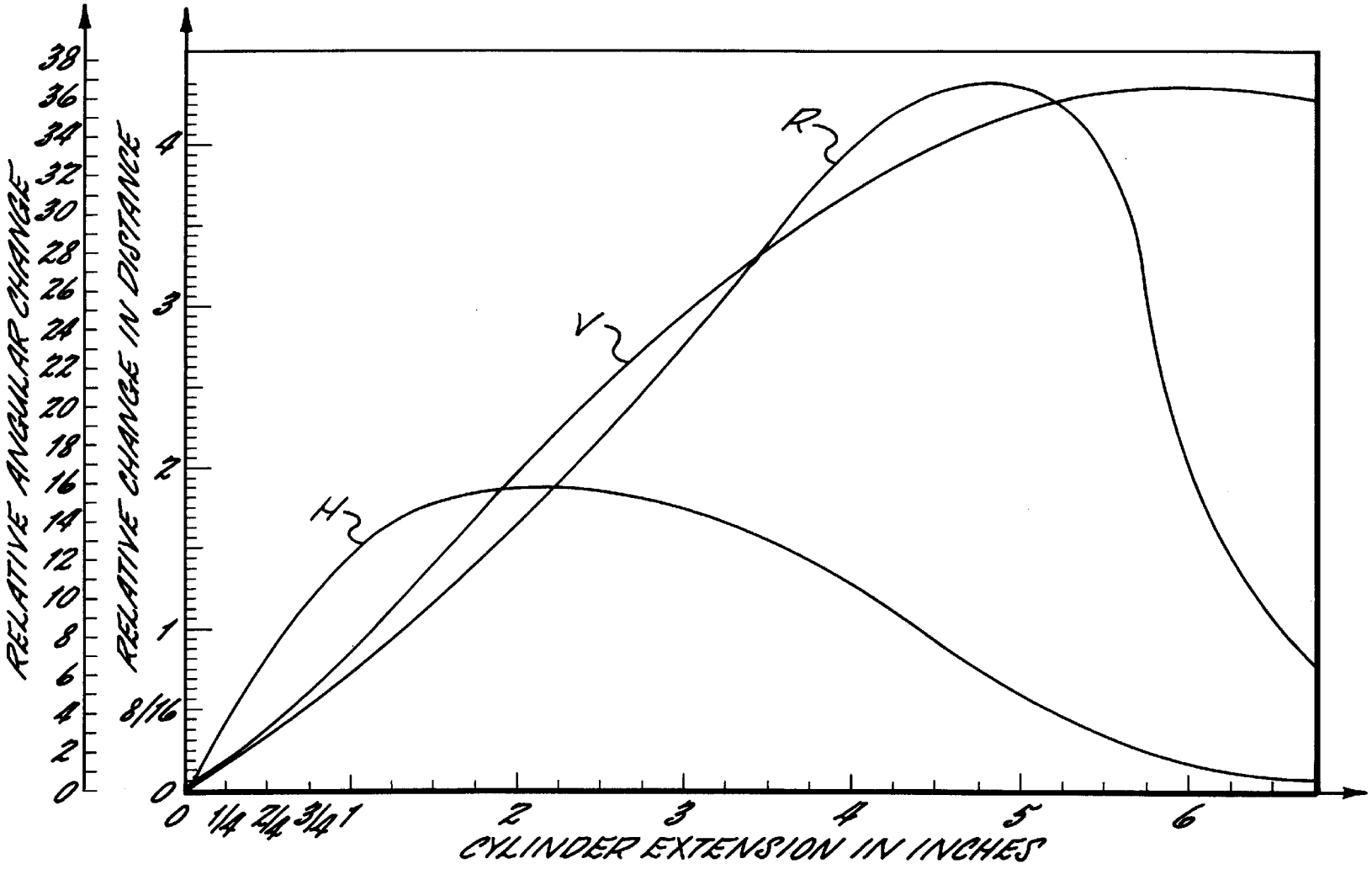
FIG. 19 is a chart showing the vertical, horizontal, and rotational movement of the pan assembly relative to the frame.

The individual components of the movement of the pan assembly 224 along a predetermined path, in this instance arcuate, are presented in a graph having a series of curves identified as FIG. 19. In the present embodiment, the cylinder rod 244 extends 6' out from the first end or cylinder 242. As previously discussed, the velocity of the movement of the cylinder rod 244 from the retracted position to the extended position is constant.

The graph shown in FIG. 19 contains curves H, V, and R, which represent the Horizontal, Vertical, and Rotational components respectively, of the pan assembly 224 as it moves through its predetermined arcuate path relative to the frame 222. Each point on the curve represents the difference in the distance, or angular displacement in the case of the rotational components, between consecutive locations of the cylinder rod 244 as it moves from the retracted position to the extended position. As may be seen by comparing the curves, and by similarly comparing FIGS. 17A through 17C, the three components of movement of the pan assembly 224 vary in magnitude as the pan assembly moves from the receiving position to the dumping position.

Point 0, on the X-axis of the graph represents the receiving position, i.e., the cylinder rod 244 is stationary. Consequently, as the cylinder rod begins to move from the retracted position toward the extended position, it can be said that movement of the pan assembly 224 occurs primarily in the horizontal direction. The majority of all horizontal movement of the pan assembly 224 relative to the frame 222 occurs within the first ⅙ of the extension of the cylinder rod 244.

Conversely, rotation of the pan assembly 224, see curve R, occurs primarily at the later stages of movement, i.e., toward the terminal portion of the arcuate path of travel. This late rotation is desirable to ensure that the lift mechanism has positioned the pan assembly 224 adjacent the refuse collection vehicle AA' before it begins to rotate and invert the refuse cart BB, thereby ensuring that the refuse falls into the collection hopper.

The early horizontal component and the delayed rotational component to the movement of the pan assembly 224 is controlled by the relative lengths of the linkages or arms of the two four bar linkages of the present invention. In addition, the use of the four bar linkages in serial connection has an important consequence as it relates to the vertical component of movement of the pan assembly 224, as represented by curve V.

The use of the two four bar linkages connected in series enables the lift mechanism 220 to take advantage of the large vertical component of movement during an initial portion of movement of the pan assembly. As shown, the pan assembly moves rapidly during the first 4 inches of movement along its arcuate path as a result of the cylinder rod 244 moving from the retracted position toward the extended position. Consequently, the pan assembly 224 can quickly lift the refuse cart BB high off of the ground.

As the cylinder rod 244 approaches the extended position and as the pan assembly correspondingly enters a terminal portion of its predetermined arcuate path, the vertical, horizontal, and rotational components of movement all decelerate despite the continued constant velocity of the cylinder rod. Consequently, the pan assembly 224 takes advantage of the natural breaking component primarily of the first four bar linkage to come to a smooth stop. The benefit of coming to a smooth stop as a result of the substantially full extension of the first four bar linkage, see the substantially vertical alignment of pivot points 264, 284, and 294, is that the refuse within the refuse cart BB will not have to overcome centrifugal inertia before the refuse begins to fall out into the refuse collection vehicle AA'. In addition, by decelerating smoothly, i.e., without a jolt, excessive wear and tear on the lift mechanism 220 and the refuse cart BB can be minimized, resulting in extended life of both. This extended life corresponds to a decrease in overall cost to operate and maintain the lift mechanism.

Many modifications and other embodiments of the invention will come to mind in one skilled in the art to which this invention pertains having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. A lifting apparatus for use with a refuse collection vehicle for lifting and dumping a refuse cart, said apparatus comprising:

a frame adapted for mounting to the refuse collection vehicle;

a pan assembly adapted to engage the refuse cart;

a reciprocating actuator having a first end and a second end movable relative to said first end between an extended position and a retracted position; and a plurality of arms pivotally connected between said pan assembly and said reciprocating actuator for moving said pan assembly along a predetermined path between a receiving position for engaging the refuse cart and a dumping position for emptying the refuse cart, said arms being cooperatingly linked so as to accelerate said pan assembly from the receiving position along an initial portion of said predetermined path and to decelerate said pan assembly along a terminal portion of said predetermined path in response to a predetermined constant velocity of said second end of said reciprocating actuator, said arms comprising two four bar linkages connected to each other in series.

2. A lifting apparatus for use with a refuse collection vehicle for lifting and dumping a refuse cart, said apparatus comprising:

a frame adapted for mounting to the refuse collection vehicle;

a pan assembly adapted to engage the refuse cart;

a reciprocating actuator having a first end and a second end movable relative to said first end; and at least two four bar linkages pivotally connected between said pan assembly and said reciprocating actuator for moving said pan assembly along a predetermined path between a receiving position for engaging the refuse cart and a dumping position for emptying the refuse cart, so as to accelerate said pan assembly from the receiving position along an initial portion of said predetermined path and to decelerate said pan assembly along a terminal portion of said predetermined path in response to a predetermined constant velocity of said second end of said reciprocating actuator.

3. An apparatus according to claim 2 wherein said plurality of arms comprises a first actuator arm connected at a first end to said frame and having a second end;

a second actuator arm having a first end connected to said frame and having a second end connected to said pan assembly;

a connecting arm having a first end pivotally connected to said first actuator arm and having a second end pivotally connected to said second actuator arm for providing corresponding movement of said second actuator arm in response to movement of said first actuator arm; and a guide arm having a first end pivotally connected to said frame and having a second end pivotally connected to said pan assembly for guiding said pan assembly along said predetermined path of travel.

4. An apparatus according to claim 2 wherein said second end of said reciprocating actuator is pivotally connected to said first actuator arm at a location spaced from said first end of said first actuator arm.

5. An apparatus according to claim 2 wherein said frame comprises a pair of opposed side members, a bottom member, and a cross member extending between said opposed side members, generally parallel to and longitudinally spaced from said bottom member.

6. An apparatus according to claim 2 wherein said apparatus comprises a slender profile when said pan assembly is in the receiving position.

7. An apparatus according to claim 2 further comprising retaining means for retaining the refuse container on said pan assembly at least when said pan assembly is in the dumping position.

8. An apparatus according to claim 2 wherein said pan assembly moves from the receiving position toward the dumping position in response to movement of said second end of said actuator moving from the retracted position toward the extended position.

9. An apparatus according to claim 2 wherein said reciprocating actuator is pivotally connected to said frame at said first end.

10. A lifting apparatus for use with a refuse collection vehicle for lifting and dumping a refuse cart, said apparatus comprising:

a frame adapted for mounting to the refuse collection vehicle;

a pan assembly adapted to engage the refuse cart;

a reciprocating actuator having a first end and a second end movable relative to said first end between an extended position and a retracted position; and a plurality of four bar linkages connected to each other in series and pivotally connected between said pan assembly and said reciprocating actuator for moving said pan assembly along a predetermined path between a receiving position for engaging the refuse cart and a dumping position for emptying the refuse cart in response to movement of said reciprocating actuator.

* * * * *

UNITED STATES PATENT AND TRADEMARK OFFICE

CERTIFICATE OF CORRECTION

PATENT NO. : 5,772,385

DATED : June 30, 1998

INVENTOR(S) : Huntoon et al.

It is certified that error appears in the above-identified patent and that said Letters Patent is hereby corrected as shown below:

On the title page, column 2, Foreign Patent Documents, line 2, "2/1964" should be --8/1967--; line 3, "8/1965" should be --5/1967--.

Signed and Sealed this

Twenty-ninth Day of September, 1998

*Attest:*

Bruce Lehman

BRUCE LEHMAN

*Attesting Officer*

*Commissioner of Patents and Trademarks*